US007453216B2

(12) United States Patent
Ushijima

(10) Patent No.: US 7,453,216 B2
(45) Date of Patent: Nov. 18, 2008

(54) CURRENT RESONANCE TYPE INVERTER CIRCUIT AND POWER CONTROLLING METHOD

(75) Inventor: Masakazu Ushijima, 30-24 Nogata 6-chome, Nakano-ku, Tokyo (JP)

(73) Assignees: Chen Hong-Gei, Taichung (TW); Masakazu Ushijima, Tokyo (JP)

( * ) Notice: Subject to any disclaimer, the term of this patent is extended or adjusted under 35 U.S.C. 154(b) by 0 days.

(21) Appl. No.: 11/261,492

(22) Filed: Oct. 31, 2005

(65) Prior Publication Data

US 2006/0164024 A1 Jul. 27, 2006

(30) Foreign Application Priority Data

Nov. 1, 2004 (JP) ..... 2004-318059

(51) Int. Cl.
*H05B 37/02* (2006.01)

(52) U.S. Cl. ..... 315/209 R; 315/291

(58) Field of Classification Search ..... 315/209 R, 315/219, 221, 224–226, 291, 362, DIG. 5.7
See application file for complete search history.

(56) References Cited

U.S. PATENT DOCUMENTS

| | | | | |
|---|---|---|---|---|
| 5,495,405 | A | 2/1996 | Fujimura et al. | |
| 5,619,106 | A | 4/1997 | Secen | |
| 5,640,313 | A * | 6/1997 | Takehara et al. | 363/97 |
| 5,666,279 | A * | 9/1997 | Takehara et al. | 363/95 |
| 6,081,439 | A * | 6/2000 | Kijima | 363/97 |
| 6,114,814 | A | 9/2000 | Shannon et al. | |
| 6,259,615 | B1 | 7/2001 | Lin | |
| 6,570,344 | B2 * | 5/2003 | Lin | 315/224 |
| 6,633,138 | B2 | 10/2003 | Shannon et al. | |
| 2002/0125836 | A1 * | 9/2002 | Chu et al. | 315/224 |

FOREIGN PATENT DOCUMENTS

| | | | |
|---|---|---|---|
| EP | 0 621 744 | A2 | 10/1994 |
| EP | 0 647 086 | A1 | 4/1995 |
| JP | 56-88678 | A | 7/1981 |
| JP | 59-32370 | A | 2/1984 |
| JP | 7-211472 | A | 8/1995 |
| JP | 8-288080 | A | 11/1996 |
| JP | 9-331680 | A | 12/1997 |
| JP | 2002-233158 | A | 8/2002 |
| JP | 2003-168585 | A | 6/2003 |

* cited by examiner

*Primary Examiner*—Trinh Vo Dinh
*Assistant Examiner*—Dieu Hien T Duong
(74) *Attorney, Agent, or Firm*—Birch, Stewart, Kolasch & Birch, LLP

(57) ABSTRACT

A high efficiency current resonance inverter circuit for a discharge lamp includes: a step-up transformer, a primary winding of the step-up transformer having a center tap being connected to a power source side, two other terminals of the primary winding being connected to collectors of two transistors, respectively, emitters of the two transistors being connected to respective terminals of a primary winding of a current transformer having a center tap, the center tap of the current transformer being connected to a ground side. A secondary winding of the current transformer is connected to bases of the two transistors to detect emitter currents of the two transistors in order to detect a resonance current, thereby performing oscillation. When the current resonance inverter circuit is used for a discharge lamp, the need for a conventional collector resonance inverter circuit is eliminated.

24 Claims, 34 Drawing Sheets

HIGH-ORDER RESONANCE

CURRENT RESONANCE TYPE INVERTER CIRCUIT AND POWER CONTROLLING METHOD

This application claims priority to Japanese Patent Application 5 No. 2004-318059 filed on Nov. 1, 2004.

TECHNICAL FIELD

The present invention relates to a dependent invention of Japanese Patent No. 2733817 (U.S. Pat. No. 5,495,405) relating to the invention of the inventor of this application or contents of the technical significance of the invention. In particular, the present invention relates to an inverter circuit for a light source, having a capacitive characteristics, such as a Cold Cathode Fluorescent Lamp (CCFL), an External Electrode Fluorescent Lamp (EEFL), or a neon lamp.

BACKGROUND OF THE INVENTION

In recent years, application of a surface light source has spread and thus the surface light source has been widely used not only in the field of an advertisement display device and a display device for a personal computer, but also in the field of a liquid crystal display television or the like.

In addition, miniaturization and high efficiency are required for inverter circuits for driving those surface light sources.

Here, a relationship between the recent changes of the inverter circuit for a cold cathode fluorescent lamp and the invention of Japanese Patent No. 2733817 is stated as follows.

As for the inverter circuit for a cold cathode fluorescent lamp, a collector resonance type circuit (refer to FIG. 17) has been widely used. This collector resonance type circuit is referred as another name to as "a Royer circuit" in some cases. However, the proper definition of the Royer circuit is such that the inversion of a switching operation is performed in a state in which a transformer is saturated. Thus, the inverter circuit which performs the inversion operation by utilizing the resonance on the collector side is desirably referred to as "a collector resonance type circuit" or "a collector resonance type Royer circuit" in distinction from the Royer circuit.

Now, the initial inverter circuit for a cold cathode fluorescent lamp did not utilize the resonance method of a secondary side circuit at all, and the so-called closed magnetic circuit type transformer having a small leakage inductance was used in a step-up transformer. In the background of the times, the so-called closed magnetic circuit type transformer method a transformer having a small leakage inductance in terms of recognition of a person skilled in the art. In addition, the leakage inductance of the step-up transformer in the inverter circuit was recognized such that it reduced an output voltage on a secondary side of a transformer and was not preferable, and thus was desirably as small as possible.

As a result, a resonance frequency of the secondary side circuit of the transformer in the background of the times was judged to have no connection with an operating frequency of the inverter circuit. Thus, the resonance frequency of the secondary side circuit used to be set to a much higher frequency than the operating frequency of the inverter circuit so as to exert no influence on the operating frequency of the inverter circuit. In addition, a ballast capacitor Cb is essential for stabilization of a lamp current.

Next, with respect to the inverter circuit for a cold cathode fluorescent lamp, an inverter circuit shown in FIG. 18 is known. However, this inverter circuit is one disclosed in Japanese Unexamined Patent Publication No. Hei 7-211472, and has come into wide use as the co-called three-time resonance circuit in which as shown in FIG. 19, the resonance frequency of the secondary side circuit is three times as high as an oscillation frequency of a primary side circuit. A step-up transformer in which a leakage inductance value is increased to some degree is suitable for one used in this case.

In this case, as shown in explanatory diagrams of FIGS. 20A to 20D, the signal having the oscillation frequency of the inverter circuit and the third-order harmonics are composed with each other to generate a signal having a trapezoid waveform.

Then, the current which is actually caused to flow through the cold cathode fluorescent lamp of the three-time resonance circuit shows a waveform as shown in FIG. 21.

There is confusion in the name of the step-up transformer in this case. There is controversy as to whether or not the step-up transformer may be referred to as "the so-called closed magnetic circuit type transformer" which is said among those skilled in the art. Thus, the definition of the name of the step-up transformer becomes vague. There is a problem as to how a state is described in which the leakage of the magnetic flux is much though the magnetic path structure is closed. A problem still exists such that those terms are not the special technical term each in which the state as described above is supposed.

The shape of the transformer which is actually used in the so-called three-time resonance is flat as shown in FIGS. 22A and 22B. Thus, though the magnetic path structure is closed, the leakage of the magnetic flux is considerably more than that of the conventional one. That is, that transformer has a large leakage inductance value.

In any case, this technical idea (refer to FIG. 18) is such that the leakage inductance value of the step-up transformer is increased to some degree, whereby a resonance circuit is structured by using a leakage inductance (Le in FIG. 18) and a capacitance component obtained on the secondary side of the step-up transformer, and a resonance frequency of the resonance circuit is set to a frequency three times as high as the operating frequency of the inverter circuit in order to generate a third-order harmonics in the secondary side circuit (refer to FIG. 19), thereby obtaining a lamp current waveform having a trapezoid shape (refer to FIG. 20D). A ballast capacitor C2 in this case, though being a ballast capacitor, functions as a part of a resonance capacitor.

As a result, as disclosed in the invention of Japanese Unexamined Patent Publication No. Hei 7-211472, the conversion efficiency of the inverter circuit is considerably improved, and also the step-up transformer is further miniaturized. In addition, this technical idea about the three-time resonance has become the basis of the collector resonance type inverter for a cold cathode fluorescent lamp from recent years up to the present time. Thus, it is not too much to say that the technique concerned is utilized in the great majority of a considerable number of collector resonance type inverter circuits which currently come into wide use.

Next, the invention of Japanese Patent No. 2733817 that becomes the basis of the present invention was disclosed, whereby more dramatic miniaturization and high efficiency promotion of the step-up transformer have been realized. The present invention began to be widely implemented in about 1996, and thus has greatly contributed to the miniaturization and high efficiency promotion of the inverter circuit used in a note type personal computer. The invention concerned is the invention such that the operating frequency of the inverter circuit and the resonance frequency of the secondary side circuit are made nearly agree with each other. The leakage inductance value of the step-up transformer in the three-time resonance is further increased, and at the same time the capacitance component of the secondary side circuit is increased, thereby realizing the invention concerned.

This technique utilizes such an effect that when the inverter circuit operates in the vicinity of the resonance frequency of the secondary side circuit, an exciting current which is caused to flow through a primary winding of the step-up transformer becomes less. Thus, a power factor when viewed from the primary winding side is enhanced, and a copper loss of the step-up transformer decreases.

Also, after the disclosure of the invention concerned, a large number of driving method, which will be described later, such as separately excited driving method having a fixed frequency, and a zero current switching type driving method for detecting a zero current of the primary side winding to perform the switching have been used as the driving method of the primary side circuit in addition to the conventional collector resonance type circuit. A series of those peripheral techniques are related to the dependent inventions of the invention concerned, and contribute to the spread of the resonance technique of the secondary side circuit in the invention concerned.

When changes of the background technique relating to a series of those inverter circuits for the cold cathode fluorescent lamps are viewed from a viewpoint of the leakage inductance value of the step-up transformer, those changes can be regarded as the history in which as the generation of the inverter circuit has been renewed, the leakage inductance value of the step-up transformer has also increased and at the same time the resonance frequency of the secondary side circuit has been lowered.

The high efficiency promotion and miniaturization of the inverter circuit are realized by improving the step-up transformer and by suitably selecting the driving frequency of the step-up transformer. For this point, the inventor of the present invention discloses in detail the technique for the high efficiency promotion when viewed from the driving method side together with a graphical representation of FIG. 23 in the invention of Japanese Unexamined Patent Publication No. 2003-168585. FIG. 23 is a graphical representation explaining the technique for improving the power factor when viewed from the driving method side. In the diagram, an axis of abscissa represents a frequency, and a represents a phase difference between a voltage phase and a current phase in a primary winding of a step-up transformer. FIG. 23 explains that the power factor is improved as è becomes nearer zero.

On the other hand, as disclosed in U.S. Pat. No. 6,114,814-B1 and Japanese Unexamined Patent Publication No. Sho 59-032370, the technical idea asserting that the high-efficiency inverter circuit is provided by the zero current switching method is firmly advocated among those skilled in the art.

However, those technical ideas lack a viewpoint of the effect of the power factor improvement in the step-up transistor, and thus are not proper in that they assert that the high efficiency results from the reduction in exothermic quantity of switching transistor.

This point will hereinafter be described in detail.

The zero current switching method is one of power controlling method of the inverter circuit, and examples of the zero current switching type circuit as shown in FIGS. 24 and 30 are disclosed as typical ones in U.S. Pat. No. 6,114,814-B1 and Japanese Unexamined Patent Publication No. Sho 59-032370. In addition, the inventor of the present invention also discloses as the same technique as that described above in Japanese Unexamined Patent Publication No. Hei 8-288080 (refer to FIG. 29). This technique will be described based on U.S. Pat. No. 6,114,814-B1 as follows.

Here, FIGS. 25A to D correspond to FIGS. 11A to 11D shown in U.S. Pat. No. 6,114,814-B1, respectively, and FIGS. 26E to F and AA and BB correspond to FIGS. 11E and 11F, and FIGS. 12A and 12B shown in U.S. Pat. No. 6,114,814-B1, respectively.

In U.S. Pat. No. 6,114,814-B1, FIGS. 11A to 11D and FIGS. 12A and 12B show waveform diagrams explaining an operation of the zero current switching type circuit of the invention concerned. FIGS. 11A and 11B in U.S. Pat. No. 6,114,814-B1 show a state in which no power control is performed, FIGS. 11C and 11D in U.S. Pat. No. 6,114,814-B1 show a state in which the power control is performed, and FIGS. 11E and 11F in U.S. Pat. No. 6,114,814-B1 show a case where the zero current switching operation is intended to be performed in a state in which a phase of an effective voltage value leads a phase of an effective current value. In addition, diagrams as shown in FIG. 26 are shown in FIGS. 12A and 12B in U.S. Pat. No. 6,114,814-B1, and such FIGS. 12A and 12B show an example of control in a case of no zero current switching operation.

In those diagrams, FIG. 11A in U.S. Pat. No. 6,114,814-B1 shows a voltage applied to a primary winding of a transformer when a driving power is the maximum, and FIG. 11B in U.S. Pat. No. 6,114,814-B1 shows a current which is caused to flow through the primary winding of the transformer in that case. The zero current switching method in the inverter circuit for a cold cathode fluorescent lamp serves to detect timing at which the current value becomes zero to turn ON a switching element. When the driving power is the maximum, i.e., when a flow angle is set to 100% and thus no power control is performed, there is necessarily no phase difference between the phase of the effective voltage value and the phase of the effective current value which is given to the primary winding. That is, this method that the power factor is satisfactory.

Next, FIG. 11C in U.S. Pat. No. 6,114,814-B1 shows a voltage applied to the primary winding of the transformer when the flow angle is made small in order to control the driving power. Also, FIG. 11D in U.S. Pat. No. 6,114,814-B1 shows a current which is caused to flow through the primary winding in this case. In this diagram, a switching transistor is turned ON at timing at which the current value becomes zero. However, turn-OFF of the switching transistor is not caused at the timing at which the current value becomes zero. In this case, there is a phase difference between the phase of the effective value of the voltage applied to the primary winding and the phase of the effective value of the current caused to flow through the primary winding. As a result, the power factor in this case is not satisfactory.

On the other hand, while FIG. 26AA shows a case where the power control is performed with the flow angle being similarly limited, the control is performed such that the phase of the effective value of the voltage in the primary winding and the phase of the effective value of the current caused to flow through the primary winding become equal to each other under a condition in which the zero current switching method is disregarded. In this case, the power factor when viewed from the primary winding side of the transformer is really satisfactory, and thus the exothermic quantity of step-up transformer is less. However, this technique is not related to zero current switching method.

Here, the zero current switching method is in consistent with the technical idea for providing the high efficiency for the inverter circuit. In the technical idea of U.S. Pat. No. 6,114,814-B1, the zero current switching method is excluded in the states as shown in FIGS. 12A and 12B in U.S. Pat. No. 6,114,814-B1 because of the unsatisfactory conversion efficiency of the inverter circuit.

However, the comparative experiments made by the inventor show that the conversion efficiency of the inverter circuit in a case of the control method shown in FIGS. 26AA and BB is obviously higher than that of the inverter circuit in a case of the control method shown in FIGS. 25C and D.

In conclusion, it is false that the zero current switching method provides the high efficiency for the inverter circuit. The background causing such misunderstanding is as follows.

Especially, only when no power control is performed in the zero current switching method, the phase difference between the phase of the voltage applied to the primary winding of the step-up transformer and the phase of the current caused to flow through the primary winding thereof necessarily disappears. For this reason, the power factor of the step-up transformer is improved, the current caused to flow through the primary winding is reduced, and the current caused to flow through the switching transistor becomes the minimum. As a result, the exothermic quantity of primary winding of the step-up transformer and the exothermic quantity of switching transistor are reduced, so that the efficiency of the inverter circuit is improved. It seems that this fact is misidentified as that the high efficiency is provided by the zero current switching method.

The state as shown in 11A and 11B in U.S. Pat. No. 6,114,814-B1 corresponds to a case where no power control is performed. An operating state in this case becomes equivalent to an operating state of the general current resonance type inverter circuit. That is, it is found out that the high-efficiency inverter circuit is not provided by the zero current switching method, but really provided by the conventional current resonance type method.

The current resonance type inverter circuit is known as one for a cold cathode fluorescent lamp, and for example, a circuit as shown in FIG. 27 is generally used as the current resonance type inverter circuit. Such a current resonance type circuit has no dimming method in a case where only a structure of a basic circuit is adopted. Then, when the dimming is performed in the current resonance type inverter circuit, the dimming is performed by using a DC-DC converter circuit is provided in a preceding state of the current resonance type inverter circuit in order to perform the dimming.

FIG. 28 shows an example of a dimming circuit in an inverter circuit for a cold cathode fluorescent lamp in which the conventional current resonance type circuit is combined with a DC-DC converter circuit provided in a preceding stage thereof. In this example, switching method Qs, a choke coil Lc, a fly-wheel diode Ds, and smoothing capacitor Cv constitute the DC-DC converter circuit.

On the other hand, a technique for performing the dimming by using an improved current resonance type circuit. FIG. 29 shows a dimming circuit which the inventor of the present invention disclosed in JAPANESE UNEXAMINED PATENT PUBLICATION 8-288080 A. In this dimming circuit, timer circuits 10 and 11 detect a zero current, and after a lapse of a predetermined period of time, a frequency controlling circuit 12 turns OFF switching elements 2 and 3. Each of the timer circuits 10 and 11 is structured in the form of an RS flip-flop, and set with the zero current and reset after a lapse of a given period of time. This dimming circuit is one for performing the dimming by utilizing a method of turning OFF switching method after a lapse of a given period of time after detecting the zero current to turn ON the switching method.

The same technique as that described above is disclosed in FIG. 9 as well of U.S. Pat. No. 6,114,814-Bi, FIG. 30 is a circuit diagram shown in FIG. 9 of U.S. Pat. No. 6,114,814-B1. In this circuit, an RS flip-flop 172 is set by a zero current, and reset after a lapse of a given period of time. Each of the techniques disclosed in U.S. Pat. No. 6,114,814-B1 and Japanese Unexamined Patent Publication No. Hei 8-288080 is such that at the same time that the zero current is detected to turn ON the switching method, the RS flip-flop is set, and reset after a lapse of a given period of time, thereby turning OFF the switching method. Each of these techniques gives the switching method of the current resonance type circuit the dimming function, and thus has such a feature that a phase of the current laps a phase of the effective voltage during the dimming phase. Thus, those techniques are established based on the completely same technical idea, and nearly identical in realization method to each other.

The inventor himself verifies that if the dimming is performed by utilizing the technique of Japanese Unexamined Patent Publication No. Hei 8-288080, when the cold cathode fluorescent lamp or hot cathode lamp is controlled so as to become considerably dark, a much current is caused to flow through the transistor constituting the switching method and thus the transistor is heated.

[Patent document 1] Japanese Patent No. 2733817

[Patent document 2] Japanese Unexamined Patent Publication No. Sho 59-032370

[Patent document 3] Japanese Unexamined Patent Publication No. Hei 7-211472

[Patent document 4] Japanese Unexamined Patent Publication 15 No. Hei 8-288080

[Patent document 5] Japanese Unexamined Patent Publication No. 2003-168585

[Patent document 6] U.S. Pat. No. 5,495,405

[Patent document 7] U.S. Pat. No. 6,114,814-B1

In the power controlling method of the inverter circuit using the conventional collector resonance type circuit, as shown in FIG. 17, the dimming of the discharge lamp is generally controlled by the DC-DC converter circuit provided in the preceding stage of the collector resonance type circuit.

In addition, the operating frequency of such a DC-DC converter circuit generally has no connection with the oscillation frequency of the inverter circuit. Thus, the switching timing depends on neither the zero voltage nor the zero current. In spite of this situation, an exothermic quantity of switching method of the DC-DC converter circuit is not so much. Thus, the DC-DC converter circuit does not reduce the conversion efficiency of the overall inverter circuit.

The reason that the conversion efficiency is low in the conventional inverter circuit is that the conversion efficiency of 35 the collector resonance type circuit is low, and is not that the conversion efficiency of the DC-DC converter circuit is low. This method that the zero current switching method does not necessarily contribute to the improvement in the conversion efficiency of the inverter circuit.

In order to verify this fact, the experiments were made in which as shown in FIG. 28, the collector resonance type circuit in the conventional inverter circuit was replaced with the current resonance type circuit. As a result, it was confirmed that though there arose such a problem that when the power source voltage was low, the satisfactory results could not be obtained in the conventional half-bridge type current resonance type circuit because the utilization efficiency of the power source was low, when the power source voltage was high, the conversion efficiency of the inverter circuit was dramatically increased.

Here, a relationship between the current resonance type circuit and the zero current switching method is summarized as follows.

When no flow angle is limited in the zero current switching method and thus no power control is performed, since as shown in FIGS. 25A and B, the phase difference between the phase of the effective voltage value and the phase of the current when viewed from the primary winding side of the transformer is small and thus the power factor is satisfactory, the conversion efficiency of the inverter circuit is also satisfactory.

Next, when the power control is performed by using the zero current switching method, the waveform of FIG. 25C is adopted in order to perform the power control. In this case, when the power control is performed with the flow angle being limited, as shown in FIGS. 25C and D, the phase difference between the phase of the effective voltage value and the phase of the current becomes large, the lowering of power factor will increase the current, and the copper loss increases accordingly, so that the thermal loss of primary winding of the transformer increases. In addition, the exothermic quantity of transistor constituting the switching method increases since the current increases. As a result, the conversion efficiency of the inverter circuit is reduced.

That is, the factor which most contributes to the improvement in the conversion efficiency of the inverter circuit for a cold cathode fluorescent lamp is not the zero current switching method. However, the effect of improving the power factor of the step-up transformer under the specific condition which is provided by the zero current switching method predominantly contributes to the improvement in the conversion efficiency of the inverter circuit for a cold cathode fluorescent lamp. The case under the specific condition corresponds to a case where no flow angle is limited. This is fit for the current resonance type circuit.

This is checked in detail as follows.

FIG. 31 is a graphical representation in the form of which the relationship between the voltage shown in FIG. 25C and the current shown in FIG. 25D is summarized and which explains a relationship between the voltage and current in the primary winding of the transformer in the zero current switching method, and their phases. That is, FIG. 31 is a graph in a case where the flow angle in FIGS. 25C and D when the power control is performed is set to about 25%. In this case, a point a in FIG. 31 represents timing at which the switching method is turned ON, while a point b represents timing at which the switching method is turned OFF. In addition, a waveform Es is one of the voltage applied to the primary winding of the transformer, a waveform Er is one of the effective value of the voltage in the primary winding of the transformer, and a waveform Iw is one of the current caused to flow through the primary winding of the transformer. As can be seen from this diagram, firstly, the turn-ON of the switching method corresponds to the zero current timing, while the turn-OFF thereof does not correspond to the zero current timing. In addition, when the zero current switching control is performed in such a manner, the waveform (current) Iw necessarily lags the waveform (effective voltage value) Er.

This is checked in more detail as follows.

Checking the relationship between the delay angle and the flow angle (duty ratio) with respect to how the waveform (current) Iw lags the waveform (effective voltage value) Er, a simple inverse proportion relationship is obtained between them. FIG. 32 shows this situation in the form of a graph.

FIG. 32 is a graphical representation which is obtained by calculating how the phase of the effective voltage value and the phase of the current change along with the change in flow angle. This diagram explains that when the flow angle is 25%, the lag angle of the current with respect to the voltage is 67.5 degrees. From this diagram, when the flow angle (duty ratio) is set to 25%, the phase lag of the current with respect to the voltage is obtained as about 67.5 degrees.

Next, FIGS. 33 and 34 are respectively a diagram and a graphical representation which are obtained by examining the power factor.

In FIG. 33, when a load current obtained through primary side conversion is assigned a, an exciting current is expressed in the form of tan °, and the current caused to flow through the primary winding is expressed in the form of 1/cosO (a reciprocal number of the power factor).

FIG. 34 is a graph which represents a relationship among a load current obtained through the primary-side conversion, the exciting current and the current caused to flow through the primary winding when the power factor is examined, and which explains that the much exciting current is caused to flow and a reactive current increases as the lag angle becomes larger.

In FIG. 34, a composite current ratio method 1/cos 6 (the reciprocal number of the power factor). FIG. 34 shows a relationship between a current lag angle 0 as lag of the current phase with respect to the phase of the effective voltage value and 1/cos 0 (the reciprocal number of the power factor). What times the primary winding current as much as the load current is caused to flow is examined as shown in FIG. 34. The current caused to flow through the primary winding when the phase of the current lags the phase of the effective voltage value by 67.5 degrees is 2.61 times as much as that when the phase of the current does not lag the phase of the effective voltage value at all. For this reason, it is understood that the power factor is very poor, and the exothermic quantity of primary winding increases due to an increase in copper loss. In addition, it is understood that the exothermic quantity of transistor constituting the switching method also increases for the same reason.

That is, when the power is controlled by using the zero current switching method, performing the power control by using the flow angle controlling method disclosed in U.S. Pat. No. 6,114,814-B1, Japanese Unexamined Patent Publication No. Hei 8-288080 or Japanese Unexamined Patent Publication No. Sho 59-032370 is concluded from a viewpoint of improvement in the power factor as follows.

The excellent conversion efficiency is obtained in the inverter circuit in a state in which the flow angle is wide, i.e., in a state in which the lag of the phase of the current with respect to the phase of the effective voltage value is small. However, when the flow angle is small, the lag of the phase of the current with respect to the phase of the effective voltage value is large, and thus the power factor becomes poor. As a result, the current caused to flow through the primary winding of the transformer increases, whereby the conversion efficiency of the converter circuit becomes worse. In particular, when the flow angle is narrow, as the lag of the current phase approaches 90 degrees, the reactive current abruptly increases, and the conversion efficiency remarkably becomes worse.

In such a state, concretely speaking, in a case where an A.C. adapter is used when the zero current switching method is applied to the notebook type personal computer, the power source voltage becomes high. Under this condition, however, when the liquid crystal panel is desired to become dark by limiting the power, the lag of the current phase becomes the highest. This case is actually accompanied with the remarkable exothermic quantity of inverter circuit.

Moreover, when the current control is performed by the zero current switching method, there is encountered such a problem that 35 it is impossible to avoid the change in operating frequency of the inverter circuit.

Here, the evident fact is that the technical idea called the zero current switching is not necessarily essential to the structure of the inverter circuit having the excellent conversion efficiency in a state in which the power control is performed. Far from that, the technical idea called the zero current switching is rather harmful than is not necessarily essential thereto. In order to structure the inverter circuit having the excellent conversion efficiency, it is necessary to exclude the above-mentioned technical idea and adopt a method of making the power factor in the primary winding of the step-up transformer the best.

As for other method of implementing the technical significance of Japanese Patent No 2733817 (U.S. Pat. No. 5,495,405), the separately excited driving method having a fixed frequency is used in many cases. In such cases, when the resonance frequency of the secondary side circuit is shifted or the driving frequency of the primary side driving circuit is shifted due to the dispersion in circuit constants, the driving cannot be performed at the optimal resonance frequency at which the power factor improvement effect is actualized in some cases.

When the resonance frequency of the secondary side circuit and the driving frequency of the primary side circuit are shifted, this makes the power factor of the inverter circuit extremely worse. From this, when the separately excited driving method having the fixed frequency is used, a Q value of the resonance circuit of the secondary side circuit is lowered to obtain the broad resonance characteristics, thereby coping with the frequency shift. From such a reason, it is difficult to increase the Q value of the secondary side resonance circuit in the separately excited driving method having the fixed frequency.

In addition, when the zero current switching method and the separately excited driving method having the fixed frequency is used, it is possible to structure the inverter circuit having the high efficiency. In this case, however, there is encountered such a problem that there are a large number of constants of the circuit components, and the zero current switching method or the separately excited driving method is expensive. On the other hand, while the collector resonance type circuit involves such a problem that the efficiency is poor and there is the much calorification, it is inexpensive. From this, the collector resonance type circuit is still firmly supported as the method for reducing the cost. Those problems are an obstacle to the spread of the high-efficiency inverter circuit.

SUMMARY OF THE INVENTION

The present invention has been made in the light of the viewpoint as described above, and it is therefore an object of the present invention to provide a higher-efficiency current resonance type inverter circuit for which the conventional collector resonance type inverter circuit for a discharge lamp is eliminated, thereby improving on the circuit disclosed in Japanese Patent No. 2733817 (U.S. Pat. No. 5,495,405).

In addition, it is another object of the present invention to improve a power factor when viewed from a primary side of a step-up transformer by providing a switching transistor for controlling a power controlling circuit, and at timing having no relation to a zero current switching method.

It is still another object of the present invention to effectively utilize a power factor improvement effect which is actualized on a primary winding side of a step-up transformer by conversely utilizing positively a timing sequence which has been conventionally excluded from the technical idea about the zero current switching method.

In order to attain the above-mentioned objects, according to an aspect of the present invention, there is provided a current resonance type inverter circuit for a discharge lamp including: a step-up transformer, a primary winding of the step-up transformer having a center tap being connected to a power source two other terminals of the primary winding being connected to collector terminals of two transistors, respectively, emitter terminals of the two transistors being connected to respective terminals of a primary winding of a current transformer having a center tap, the center tap of the current transformer being connected to a ground side, a secondary winding of the current transformer being connected to bases of the two transistors to detect emitter currents of the two transistors in order to detect a resonance current, thereby performing oscillation. A secondary side circuit of the step-up transformer includes a small leakage inductance value, the secondary side circuit of the step-up transformer includes the discharge lamp, the secondary side circuit of the step-up transformer includes a distributed capacitance, a suitably added capacitor and a stray capacitance generated in the vicinity of the discharge lamp. These capacitance components are composed with one another to form a secondary side capacitance. The secondary side capacitance and the leakage inductance constitute a series resonance circuit, and the discharge lamp is connected in parallel with the capacitance components to constitute the series resonance circuit having a high Q value, whereby a high step-up ratio is obtained to turn ON the discharge lamp, and a phase difference between a voltage and a current when viewed from the transformer primary winding side is generally small.

Preferably, the current resonance type inverter circuit for a discharge lamp further includes a switching transistor for controlling a power circuit of the current resonance type inverter circuit for a discharge lamp, between the center tap of the step-up transformer and the power source, in which switching timing of the switching transistor for the power control is made irrespective of an oscillation frequency of the current resonance type inverter circuit, thereby preventing a power factor when viewed from the primary winding side of the step-up transformer from being made worse.

In addition, it is yet another aspect of the present invention to provide a driving method having an excellent power factor by synchronizing the switching timing for power control with an oscillation frequency of an inverter circuit to make a phase of an effective voltage value equal to a phase of a current.

According to the present invention, though nearly the same circuit structure as that of the conventional collector resonance type circuit is adopted, the conversion efficiency of the inverter circuit can be greatly enhanced without requiring a large circuit change from the conventional collector resonance type circuit. As a result, the exothermic quantity of inverter circuit can be reduced. In this case, the inverter circuit is very inexpensive since the inexpensive IC for the power control which has been used in the collector resonance type circuit can be applied to the inverter circuit as it is.

In addition, since the resonance frequency of the secondary side resonance circuit is exactly reflected in the operating frequency of the inverter circuit, it is easy to cope with the frequency shift as well or the like due to the change in stray capacitance, and thus the reliability of the inverter circuit is enhanced.

While the value of the stray capacitance generated in the vicinity of the discharge lamp is an important parameter used to determine the resonance frequency of the secondary side circuit, at a time point of application of the present invention, there is still no sign of establishing the stray capacitance in the form of a specification.

This is a serious problem in terms of the industrial development. However, according to the present invention, since the current resonance type circuit automatically searches for the optimal driving frequency, even if those important parameters are undisclosed, the inverter circuit automatically operates at the resonance frequency of the secondary side circuit. In addition, it is expected that the enlightenment relating to the importance of the stray capacitance in the vicinity of the discharge lamp of the secondary side circuit is understood by a person skilled in the art.

In addition, according to the present invention, since the Q value of the secondary side resonance circuit can be set as high, it is possible to stabilize the operating frequency of the inverter circuit, and it is possible to realize the inverter circuit which is small in frequency change even when the power control is performed.

In addition, the transformer is also miniaturized. Conversely, when the transformer having the same outer diameter size as that of the transformer which has been conventionally used in the collector resonance type circuit, the transformer can be used with the power which is about 50% to about 100% larger than that of the collector resonance type circuit. In this case, it goes without saying that the number of turns of the secondary winding needs to be changed so that the secondary winding has a moderate leakage inductance value. It also goes without saying that while the transformer realized in such a manner is identical in outer diameter size to the conventional one, it is completely different in electrical characteristics from the conventional one.

Moreover, it is possible to obtain the effect of sufficiently suppressing the parasitic oscillation in the secondary winding of the transformer. As a result, the current waveform in the primary winding of the transformer becomes near a sine wave.

Further, plural of discharge lamps can be simultaneously turned ON by only one inverter circuit, which results in that it becomes possible to readily realize the inverter circuit for turning ON a plural of discharge lamps by the one inverter circuit.

Furthermore, it becomes possible to realize the inverter circuit which can be driven at the high voltage due to the resonance step-up voltage even in driving an External Electrode Fluorescent Lamp (EEFL) or the like, and which can also be driven at high efficiency.

DETAILED DESCRIPTION OF PREFERRED EMBODIMENTS

Hereinafter, preferred embodiments of the present invention will be described in detail with reference to the accompanying drawings.

Embodiment 1

Figure 1:
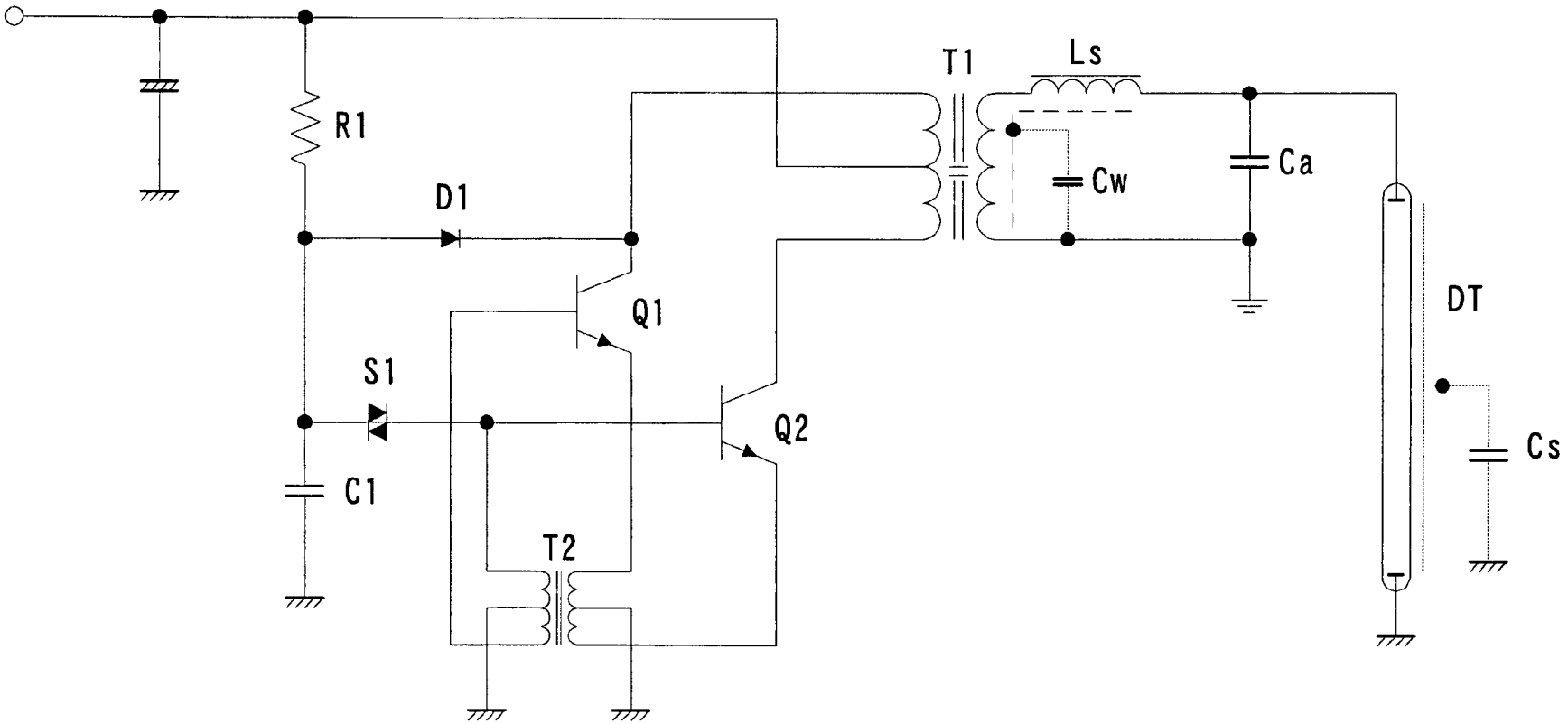
FIG. 1 is an equivalent circuit diagram showing Embodiment 1 of the present invention.

FIG. 1 is an equivalent circuit diagram showing Embodiment 1 of the present invention. In the diagram, reference symbol T1 designates a step-up transformer which has a leakage flux property and which has a center tap. The step-up transformer T1 has a leakage inductance Ls. In addition, a secondary side winding of the step-up transformer Ti constitutes a distributed constant delay circuit which has a distributed capacitance Cw. Also, reference symbol Ca designates a capacitor which is suitably added in order to adjust a resonance frequency, and reference symbol Cs designates a stray capacitance which is generated in the vicinity of a discharge lamp. Reference symbols Q1 and Q2 designate transistors constituting switching transistors, respectively. Collectors of the transistors Q1 and Q2 are connected to a leading end and a trailing end of a primary winding of the transformer T1. In addition, a transformer T2 is a current transformer, and opposite ends of its primary side winding are connected to emitters of the transistors Q1 and Q2 so as to detect emitter currents which are caused to flow through the transistors Q1 and Q2, respectively. Also, the connection is made so that the currents detected by the transformer T2 are positively fed back to bases of the transistors Q1 and Q2, respectively.

Figure 2:
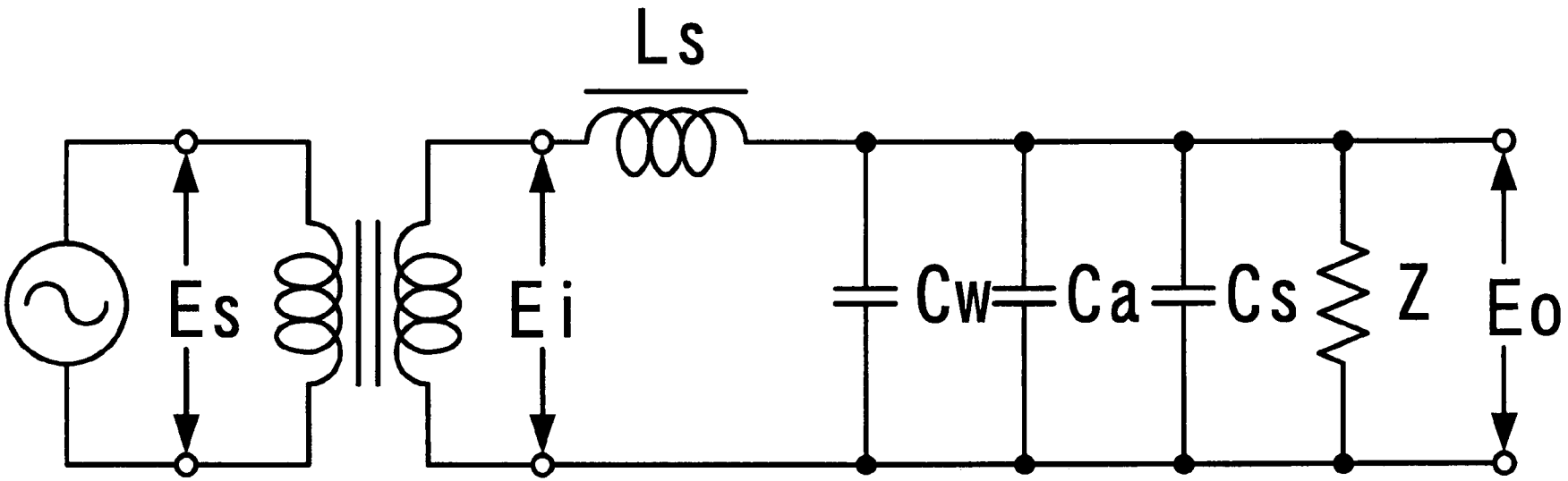
FIG. 2 is an equivalent circuit diagram showing a resonance circuit on a secondary side of a step-up transistor.

On the other hand, while in this case, the primary winding of the transformer T2 has a center tap, the primary winding of the transformer T2 may be divided into two parts in order to detect the current caused to flow through the collector windings of the transistors. Each of these ideas becomes equal to the technical idea of the present invention. Capacitance components Cw, Ca and Cs of the secondary side circuit are composed with one another to form a resonance capacitor. The resonance capacitor constitutes together with a leakage inductance Ls a series resonance circuit as shown in FIG. 2. FIG. 2 is an equivalent circuit diagram showing a resonance circuit on a secondary side of the step-up transformer T1. In FIG. 2, reference symbol Z designates an impedance of the discharge lamp. Also, reference symbols Ei=Es·k·N2/N1, and k designate coupling coefficients, respectively, and reference symbols N1 and N2 designate the number of turns of the primary winding, and the number of turns of the secondary winding, respectively.

An oscillation frequency of the inverter circuit is determined by a resonance frequency of the secondary side circuit. When the resonance frequency is assigned fr, the resonance frequency fr is expressed as follows:

$$f_r = \frac{1}{2\pi\sqrt{L_s \cdot (C_W + C_a + C_s)}}$$

A slightly low frequency becomes the oscillation frequency of the current resonance type circuit based on an operation of a parallel loaded serial resonance circuit.

Taking a secondary circuit when being driven by a separately excited fixed frequency method as an example, for those constants of the secondary side circuit, in an example of a 14 inch notebook type personal computer, conventionally, the impedance of the discharge lamp has been about 100 kQ, and the operating frequency of the inverter circuit has been about 60 kHz. Under those conditions, a proper value of the leakage inductance Ls has been in the range of 240 to 280 mH, and a proper value of the secondary side capacitance has been in the range of 25 to 30 pF.

As in the example described above, conventionally, the leakage inductance Ls and the reactance of the secondary side capacitance at 60 kHz have been about 100 kQ each, and a value which nearly agrees with the impedance of the discharge lamp has been a proper value therefor. A Q value of the resonance circuit in this case is about 1 or a value slightly larger than 1. In a case of the separately excited fixed frequency method, increasing excessively the Q value is not preferable from a viewpoint of the reliability of the circuit.

On the other hand, in the present invention, in order to obtain the large Q value, it is desirable that the leakage inductance Ls is made small and the secondary side capacitance is made relatively large. In addition, since this circuit is the parallel loaded serial resonance circuit in which in the secondary side resonance circuit, the load is connected in parallel with the capacitance component of the series resonance circuit, when the Q value becomes smaller than 1, the circuit does not continue to oscillate.

Incidentally, in the present invention, the circuit is basically of the current resonance type. Thus, no oscillation is activated after the power source is turned ON unless any activating transistor is provided.

Embodiment 2

Figure 3:
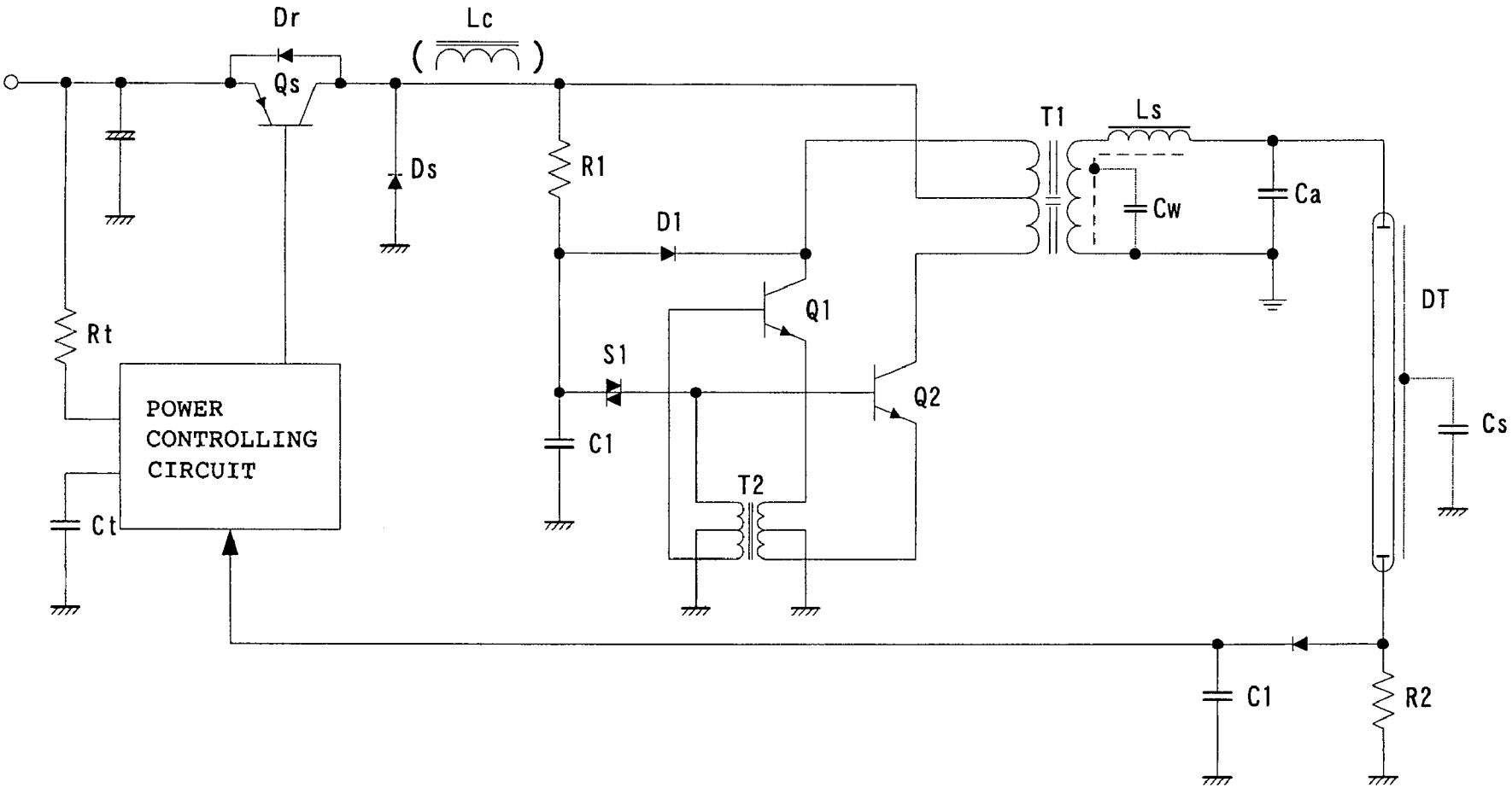
FIG. 3 is an equivalent circuit diagram showing Embodiment 2 of the present invention.
Figure 4:
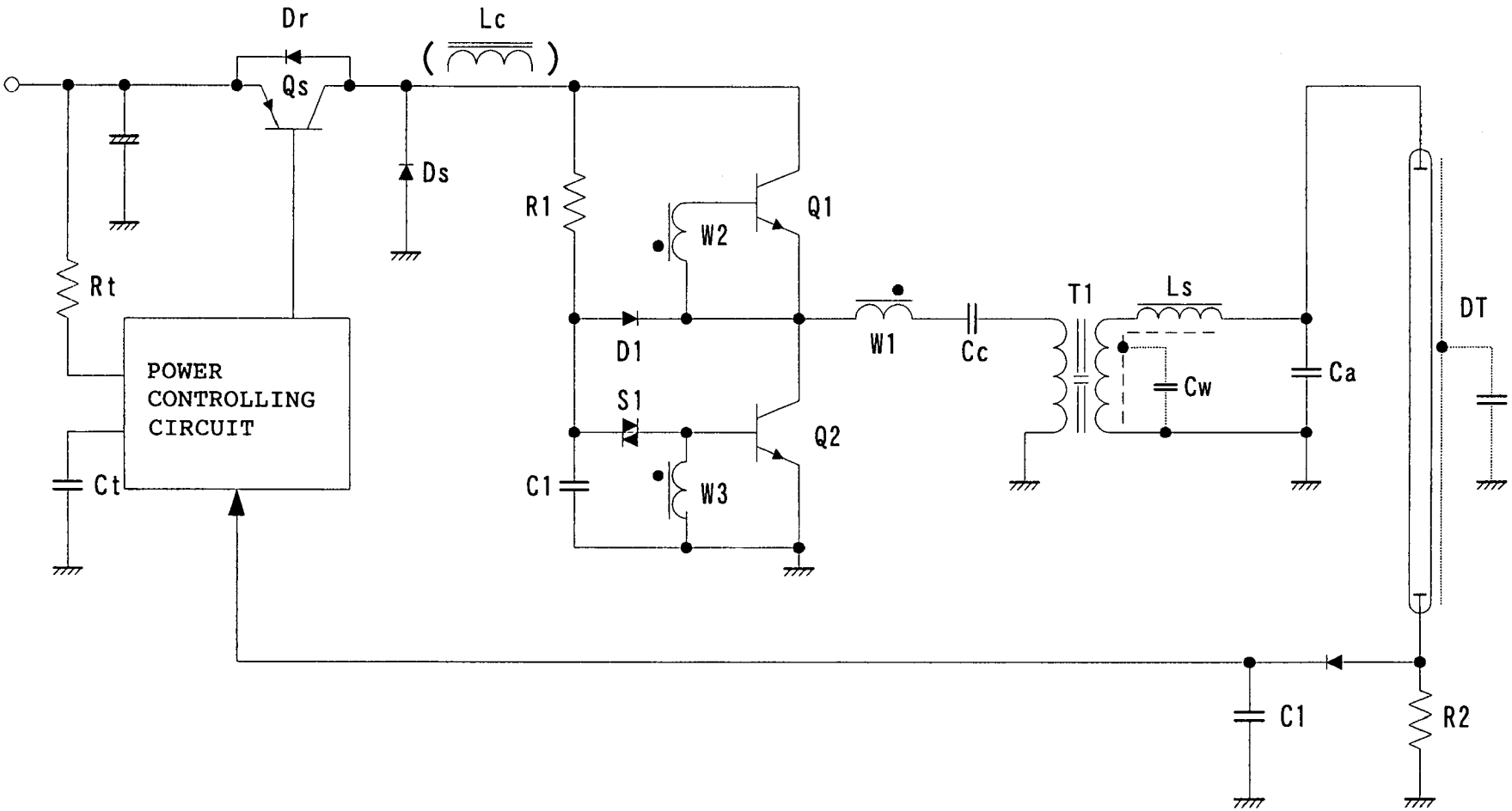
FIG. 4 is an equivalent circuit diagram in a case where Embodiment 2 of the present invention is implemented for a conventional half-bridge type current resonance type circuit.

Next, FIG. 3 is an equivalent circuit diagram showing Embodiment 2 of the present invention. In Embodiment 2, a DC-DC converter circuit is additionally provided in a preceding state of the circuit of Embodiment 1 shown in FIG. 1. Here, a resistor R1, a capacitor C1, a thyristor S1, and a diode D1 constitute an activating circuit thereof. While Rt and Ct are time constants on which a switching frequency of the DC-DC converter depends, these time constants are set irrespective of the oscillation frequency of the current resonance type circuit provided in a subsequent stage. Reference symbol Qs designates a switching transistor of the DC-DC converter, and reference symbol Ds designates a fly-wheel diode which makes an important operation as well which will be described later. In addition, reference symbol Dr designates a regenerative diode. The transistors Q1 and Q2, the switching transistor Qs, the fly-wheel diode Ds, and the regenerative diode Dr may be replaced with switching transistor comprised of a MOSFET or the like. Also, since the gist of the present invention can be applied to the overall current resonance type circuit, the current resonance type self-oscillation circuit may be replaced with a half-bridge type current resonance circuit or the like as shown in FIG. 4. That is, FIG. 4 shows an equivalent circuit diagram when Embodiment 2 of the present invention is implemented for a conventional half-bridge type current resonance circuit.

One feature of the present invention is that no smoothing capacitor is provided right behind the fly-wheel diode Ds or the choke coil Le. Thus, the one feature of the present invention is not that the mere DC-DC converter is provided. In addition, another feature of the present invention is that the choke coil Lc of the DC-DC converter circuit is not made essential. In this case, the inductance corresponding to the choke coil Lc corresponds to a primary side leakage inductance of the step-up transformer T1. In order to realize such a circuit, the step-up transformer T1 needs to be a leakage flux type transformer. On the other hand, when the leakage inductance value on the primary winding side is insufficient, an inductor may be suitably added. Consequently, the present invention does not exclude the choke coil which is suitably inserted.

The principal object of the present invention is to make the switching timing of the switching transistor Qs constituting the switching transistor have no connection with the oscillation frequency of the inverter circuit. From this, in the current resonance type circuit, the phase of the effective value of the voltage applied to the primary winding of the transformer becomes nearly equal to that of the current caused to flow through the primary winding of the transformer, and thus the power factor is improved.

Now, another method for improving the power factor is known. This method is to utilize the timing sequence, shown in FIGS. 26 12A and 12B, which is excluded in U.S. Pat. No. 6,114,814-B1. In this case, the oscillation frequency of the current resonance type circuit and the oscillation frequency of the power controlling circuit need to be synchronous with each other.

Embodiment 3

Figure 5:
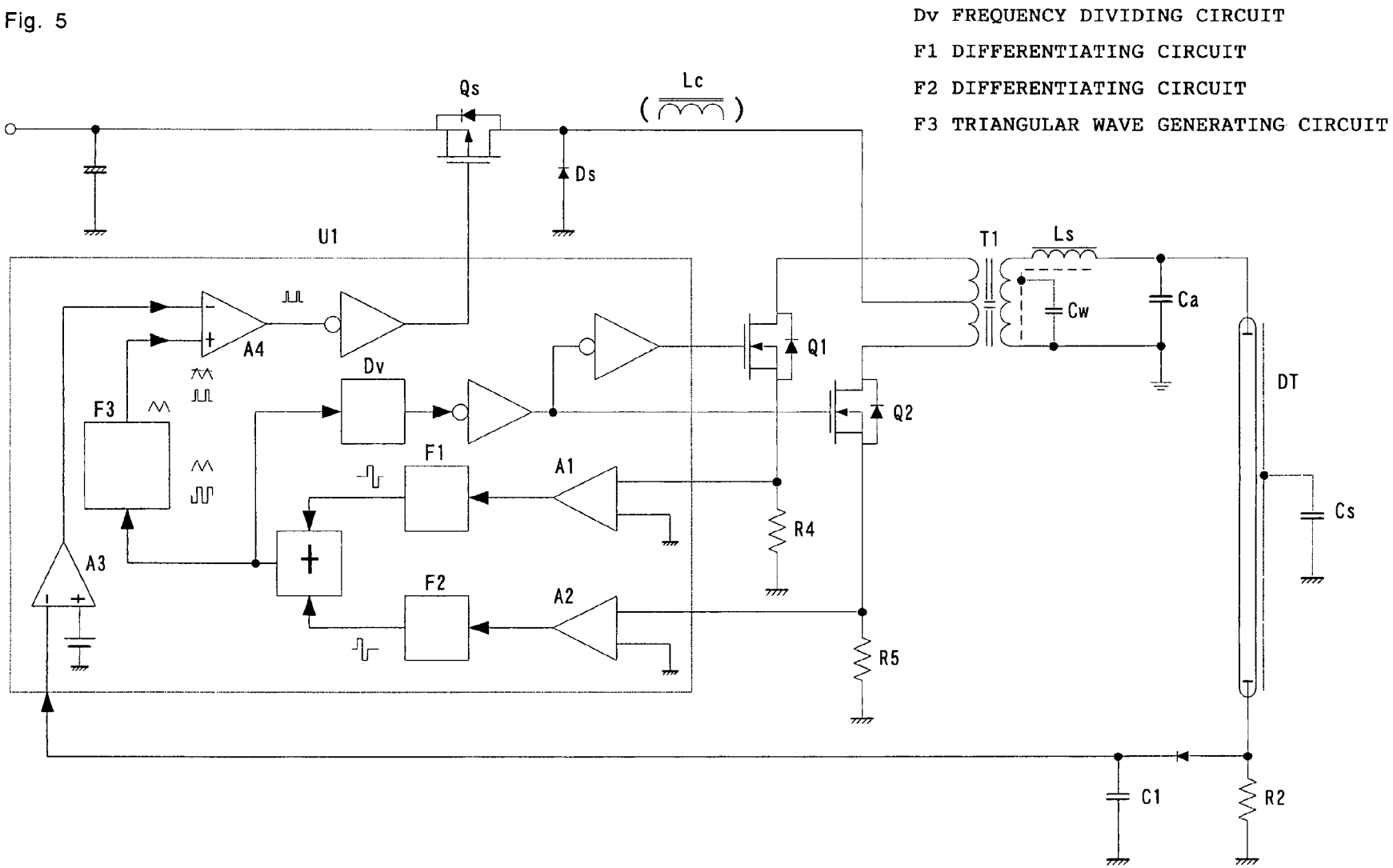
FIG. 5 is an equivalent circuit diagram showing Embodiment 3 of the present invention.
Figures 6G, 6H, 6I, 6J, 6K:
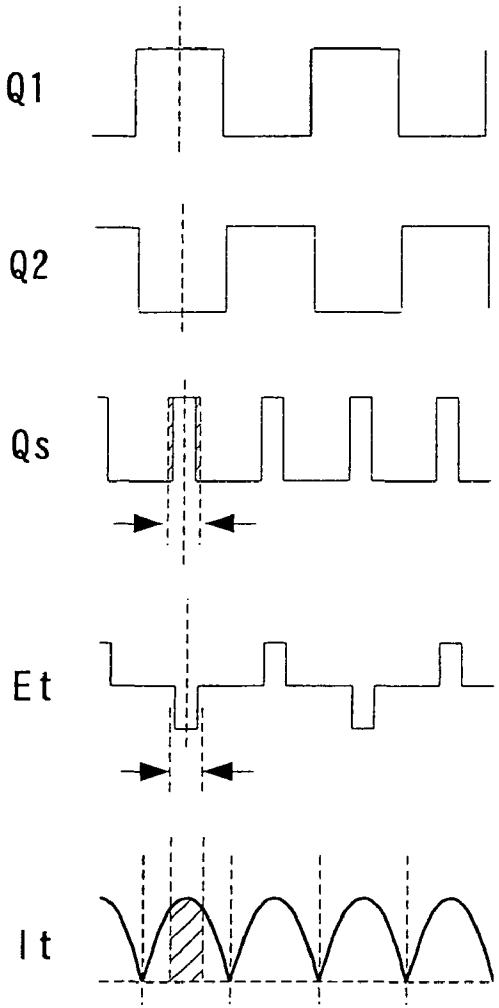
FIGS. 6A to 6K are waveform diagrams showing waveforms in respective portions of a control circuit of Embodiment 3 of the present invention.
Figures 6A, 6B, 6C, 6D, 6E, 6F:
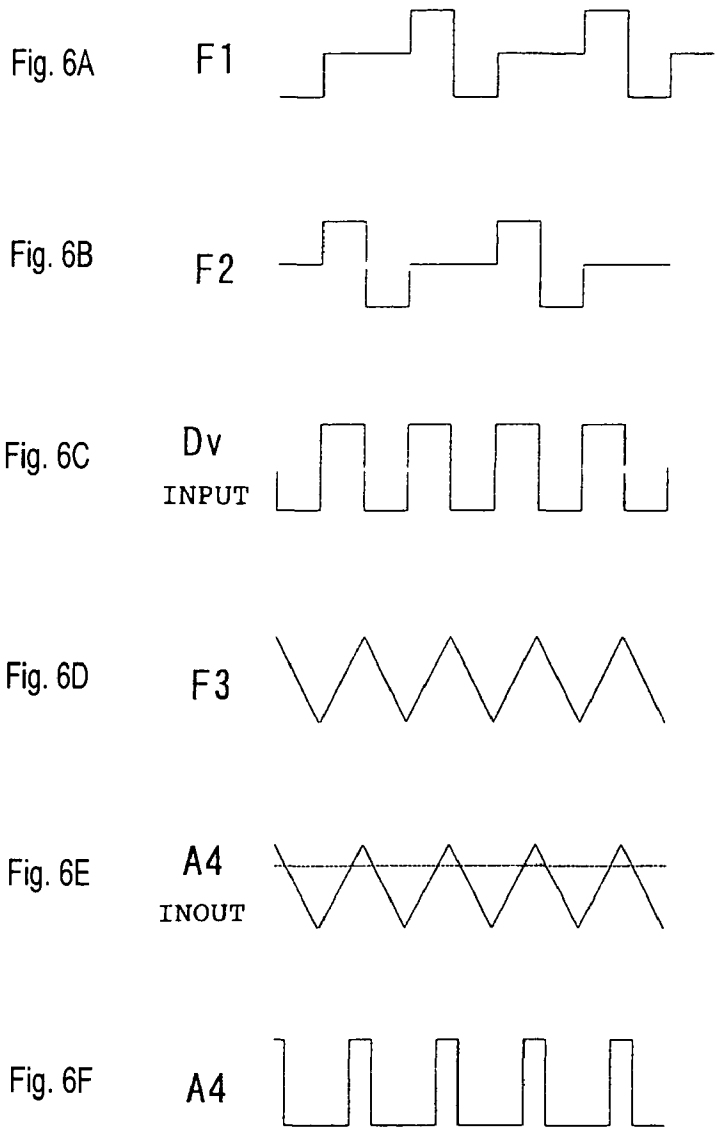

FIG. 5 is an equivalent circuit diagram showing Embodiment 3 of the present invention.

Emitters of transistors Q1 and Q2 constituting switching transistor are connected to the ground through current detecting resistors R4 and R5, respectively. The current detecting resistors R4 and R5 are resistors for detecting a resonance circuit. Amplifiers A1 and A2 serve to detect a voltage developed across the resistor R4, and a voltage developed across the resistor R5, respectively. Differentiating circuits F1 and F2 shape the detected voltages, respectively, and a composite signal is supplied to a triangular wave generating circuit F3 and a frequency dividing circuit Dv, respectively. The transistors Q1 and Q2 are driven by a voltage which is obtained through the frequency division in the frequency dividing circuit Dv. Thus, the structure of the current resonance type self-oscillation circuit is realized. In addition, the frequency dividing circuit Dv is made serve as a function as well of a multi vibrator, whereby the frequency dividing circuit Dv can also be used for activating the current resonance type circuit.

On the other hand, after being fed back to an error amplifier A3, a lamp current of the discharge lamp is amplified by the error amplifier A3 and compared with the triangular wave signal in a comparator A4, thereby generating a switching signal of the switching transistor Q2. FIGS. 6A to 6K show waveforms in the respective portions of the control circuit. The switching operations of the transistors Q1 and Q2 constituting the switching transistors are performed at timing at which a current It caused to flow through the primary winding of the step-up transformer T1 becomes zero. Hence, the phase of the current phase and the phases of the switching signals of the transistors Q1 and Q2 are equal to each other.

On the other hand, the switching operation of the switching transistor Qs is performed at timing at which the waveform of the current caused to flow through the step-up transformer T1 becomes symmetrical about its peak. Consequently, the phase of the effective value of the voltage applied to the primary winding of the step-up transformer T1 becomes equal to that of the current, and thus the power factor is improved.

Figure 7:
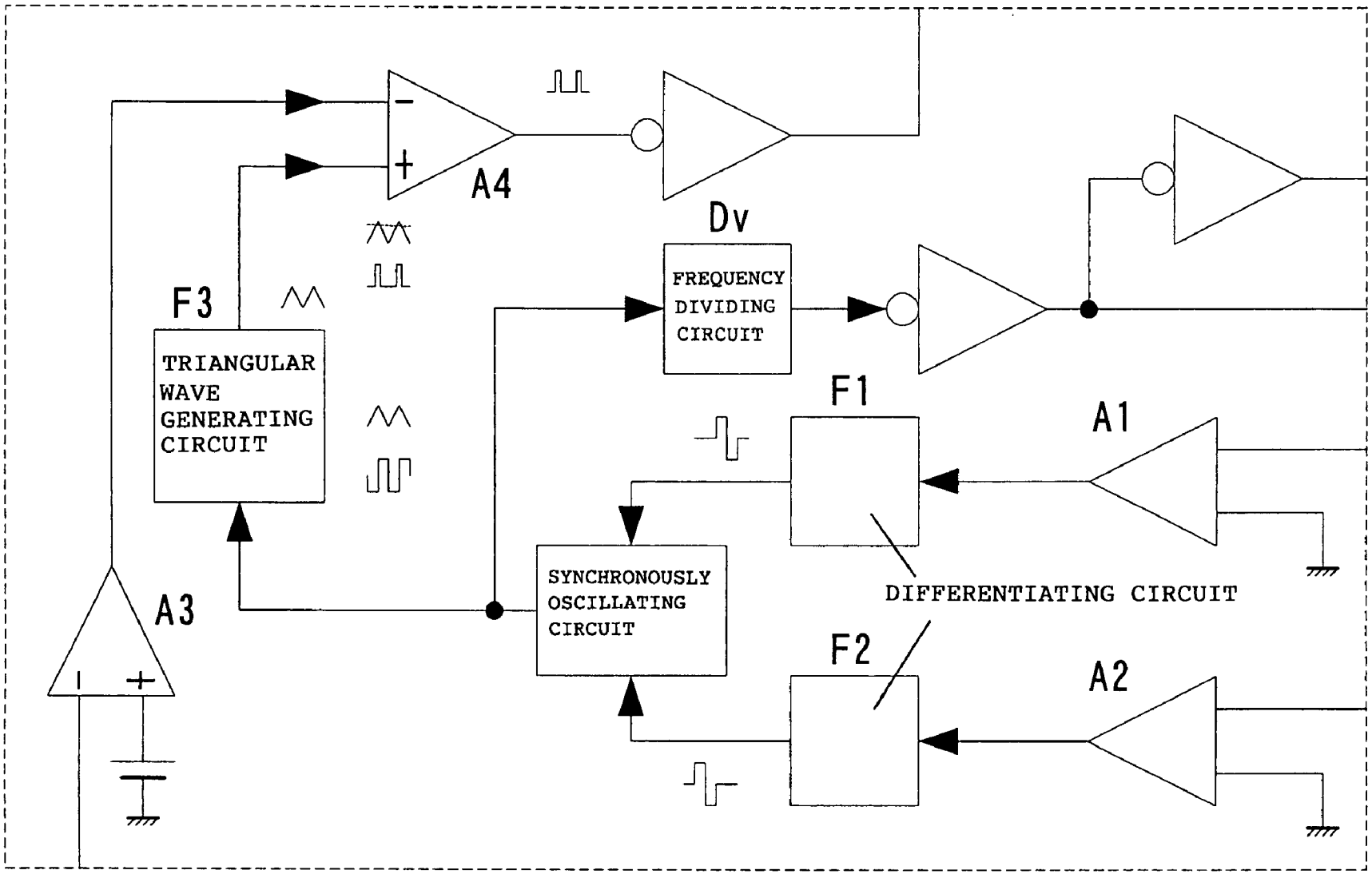
FIG. 7 is a circuit diagram showing an example of a current resonance type circuit self-containing a synchronous oscillation circuit is used as well for activating the current resonance type circuit.

FIG. 7 is a circuit diagram showing an example of the current resonance type circuit self-containing a synchronously oscillating circuit is used as well for activating the current resonance type circuit and serves to shape the waveform of the detected current and uniform the output waveform at given intervals. This synchronous oscillation circuit may be any of a resonance leading-in type, a relaxation oscillation type, a PLL type, etc. Operation Next, a description will be given with respect to a general theory about why the current resonance type driving method provides the high efficiency for the inverter circuit.

Figure 8:
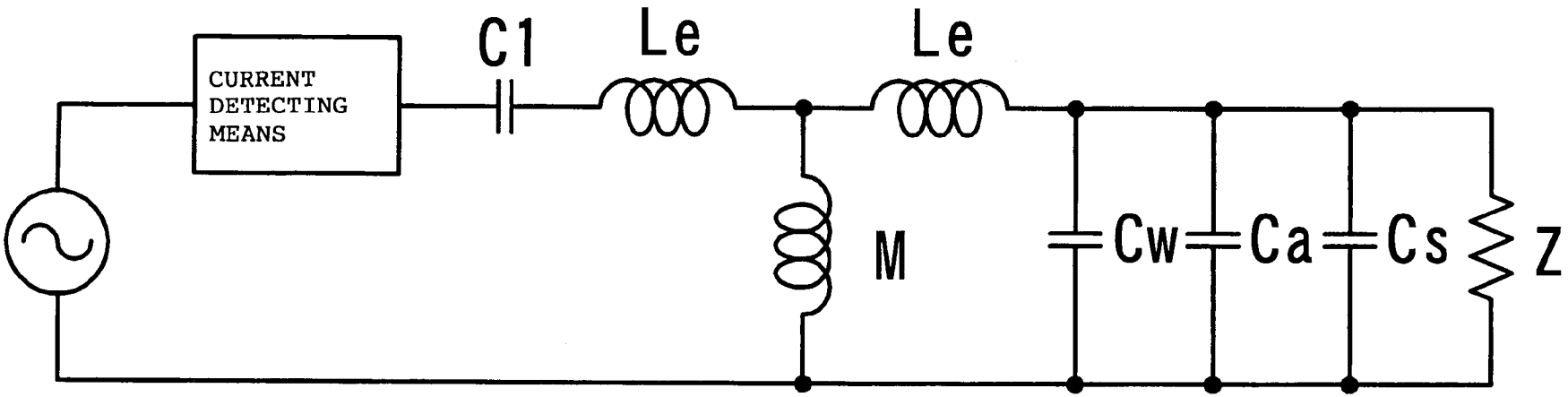
FIG. 8 is an equivalent circuit diagram of a secondary side resonance circuit including up to a primary side driving circuit of a step-up transformer of Embodiment 3 of the present invention.

FIG. 8 is an equivalent circuit diagram of the secondary side resonance circuit including up to the primary side driving circuit of the step-up transformer, and shows a relationship between the step-up transformer and the cold cathode fluorescent lamp in the inverter circuit for a cold cathode fluorescent lamp. In this equivalent circuit diagram, the step-up transformer is expressed in the form of a three-terminal equivalent circuit. The three-terminal equivalent circuit is referred to as "a tank circuit" in U.S. Pat. No. 6,114,814-B1, U.S. Pat. Nos. 6,633,138 and 6,259,615, and Japanese Unexamined Patent Publication No. 2002-233158, while it is referred to as "a resonance circuit" in the resonance circuit described in Japanese Unexamined Patent Publication No. Sho 59-032370 and the invention of Japanese Patent No. 2733817 (U.S. Pat. No. 5,495,405) made by the inventor of the present invention, and in Japanese Unexamined Patent Publication No. 2003-168585. In any case, the tank circuit and the resonance circuit mean the same circuit.

In the diagram, reference symbol C1 designates a coupling capacitor on the primary side which is inserted if necessary for the purpose of cutting a D.C. component in the current resonance type circuit, or for the purpose of cutting a D.C. component due to unbalance of the switching when the driving method is composed of a full-fridge (F-Bridge) circuit. It is generally advisable in the inverter circuit for a cold cathode fluorescent lamp that the coupling capacitor C1 having a sufficiently large capacitance value is inserted, thereby preventing the coupling capacitor C1 from participating in the resonance. This technical idea is different from that for the current resonance type inverter circuit for a hot cathode lamp. It should be noted that when the coupling capacitor C1 is made participate in the resonance, the exothermic quantity of inverter circuit increases and thus the conversion efficiency is reduced.

Reference symbol Le designates a leakage inductance of the transformer (scientific society) which is distinguished from a leakage inductance Ls (JIS) measured by utilizing the JIS measuring method. Reference symbol M designates a mutual inductance. Reference symbol Cw designates a distributed capacitance of the secondary winding, reference symbol Ca designates a resonance capacitance which is suitably added in order to adjust a resonance frequency, and reference symbol Cs designates a stray capacitance which is generated in the vicinity of the discharge lamp. The distributed capacitance Cw, the resonance capacitance Ca, and the stray capacitance Cs are composed with one another to form a resonance capacitance on the secondary side. Also, reference symbol Z designates an impedance of the discharge lamp.

By the way, when a self-inductance of a winding of a transformer is assigned Lo, and a coupling coefficient is assigned k, the following relationship is established among these factors:

$$Le = k \cdot Lo$$

$$M = (1 - k) \cdot Lo$$

$$L_s = L_e + \frac{1}{\frac{1}{L_e} + \frac{1}{M}}$$

It should be noted that in a general current resonance type circuit, the transistor for detecting a resonance current is disposed on a primary side of a transformer, and detects an input current on the primary side of the transformer.

Performing the circuit simulation by using that equivalent circuit, the following results are obtained.

Figure 9A:
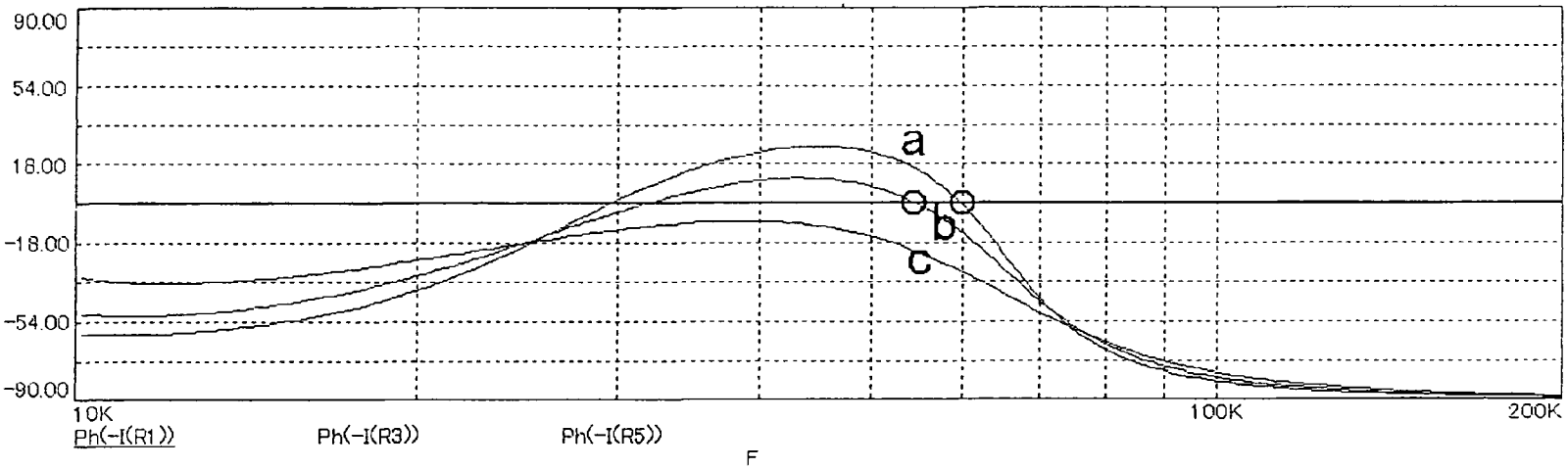
FIGS. 9A and 9B are respectively a graphical representation showing phase characteristics of a voltage and a current when viewed from a primary side of a transformer, and a graphical representation showing transfer characteristics of a voltage applied to an impedance of a discharge lamp.
Figure 9B:
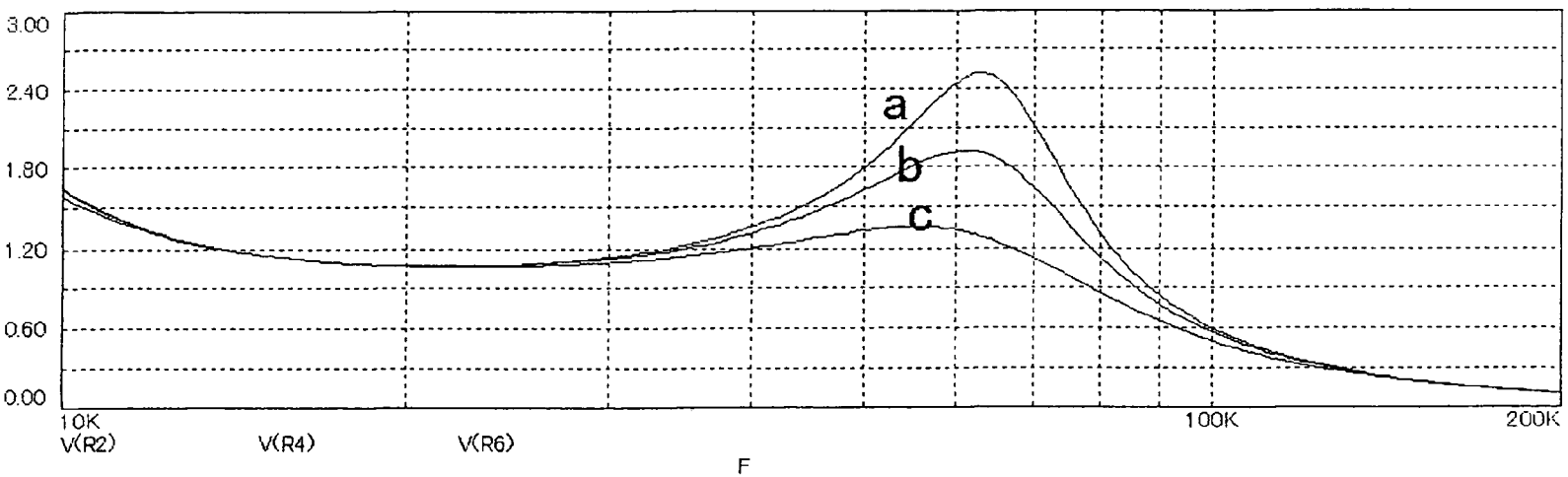

In FIGS. 9A and 9B, an axis of abscissa represents the driving 30 frequency of the inverter circuit. FIG. 9A is a graphical representation showing phase characteristics of the voltage and the current when viewed from the primary side of the transformer. FIG. 9B is a graphical representation showing transfer characteristics of the voltage applied to the impedance Z of the discharge lamp. In these diagrams, the impedance Z of the discharge lamp is changed in three stages: a first stage a represents a case of a large impedance; a second stage b represents a case of a middle impedance; and a third stage c represents a case of a small impedance.

In the half-bridge type current resonance circuit which is generally used as a lighting circuit for a hot cathode lamp, the resonance circuit is connected in series with a load and thus has no step-up operation for the load during a stationary discharge phase. On the other hand, when the cold cathode fluorescent lamp is driven, since the resonance circuit on the secondary side becomes the parallel loaded serial resonance circuit, it has the step-up operation for the load even during the stationary discharge phase. In this case, in FIG. 9A, the driving frequency of the inverter circuit is determined at a frequency at which the phase characteristic curve crosses a line representing a phase lag of 0 degree.

Considering the phase characteristics when the impedance Z of the discharge lamp is changed in the three stages, i.e., the stage of the large impedance, the stage of the middle impedance, and the stage of the small impedance, as shown in FIG. 9A, as the impedance of the discharge lamp becomes lower than that of the resonance circuit, the phase of the current detected by the detecting means shown in FIG. 8 lags the phase of the resonance current. Thus, the inverter circuit oscillates at a lower frequency than the resonance frequency of the resonance circuit. As a result, in the case of the small impedance, no frequency is obtained at which the phase characteristic curve crosses the line representing the phase lag of 0 degree. This method that when the impedance Z of the discharge lamp is beyond a certain limit to become small, the current resonance type inverter circuit can not continuously oscillate.

When the impedance Z of the discharge lamp is small, this method that the Q value of the resonance circuit is small. That is to say, in the present invention, the circuit can not continuously oscillate in the state in which the Q value is small. Consequently, in the present invention, the condition of the large Q value becomes essential to a structure of the circuit.

On the other hand, the condition of the large Q value advantageously functions in the present invention. The reason for this is that the resonance current of the secondary side circuit becomes much and the oscillation of the current resonance type circuit is stabilized as the Q value becomes larger. In addition, when the Q value is large, this method that the step-up ratio of the step-up transformer also increases.

In order to concretely structure the resonance circuit having the large Q value, it is required that the number of turns of the secondary wiring of the step-up transformer is made smaller than that of the secondary winding in the case of the conventional separately excited driving method and also the value of the capacitance component on the secondary side is set as large. Since the value of the leakage inductance is proportional to a square of the number of turns of the secondary winding, it is largely reduced by only slightly reducing the number of turns. As a result, since a ratio of transformation required to obtain the necessary voltage can be made small, the step-up transformer can be further miniaturized.

Next, a relationship between the current resonance type circuit and power controlling method of the present invention is described as follows.

When the switching timing of the respective switching transistors in the circuit shown in FIG. 5 are examined, FIGS. 10A to 10D are obtained. FIGS. 10A to 10D are waveform diagrams explaining a relationship between the switching timing of the respective switching transistors and the current in Embodiment 3. The switching transistor Qs is synchronized in switching timing with the transistors Q1 and Q2, and the switching of the switching transistor Qs is performed so that the phases of the currents caused to flow through the transistors Q1 and Q2, and the phase of the effective value of the voltage applied to the primary winding of the step-up transformer T1 become equal to each other. In this case, a current which is caused to flow through the center tap of the step-up transformer T1 is expressed in the form of It shown in FIG. 10D.

Figure 10A:
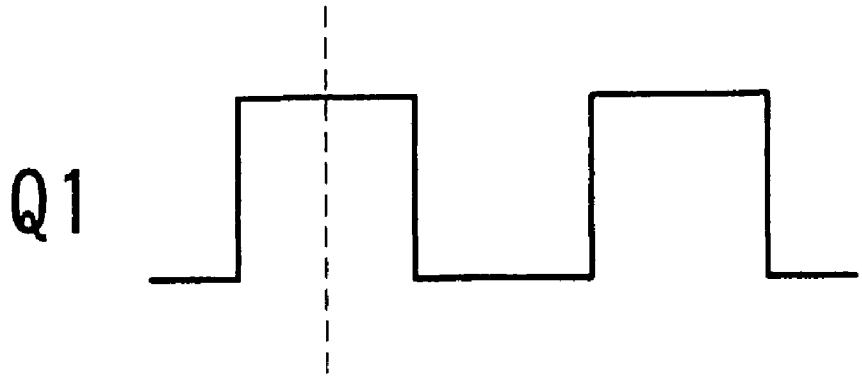
FIGS. 10A to 10D are waveform diagrams explaining a relationship between switching timing of individual switching transistors and a current in Embodiment 3 of the present invention.
Figure 10B:
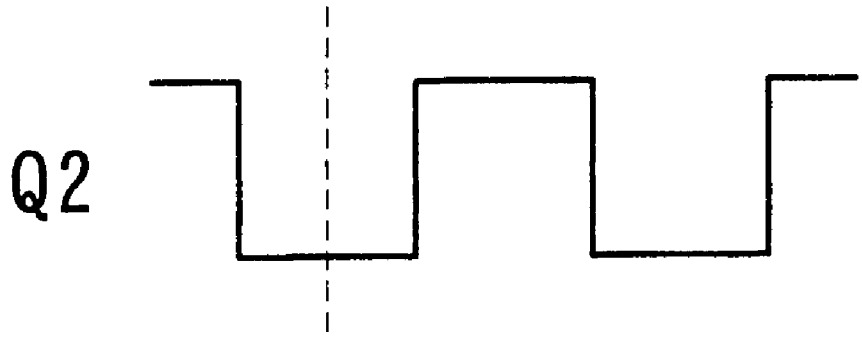
Figure 10C:
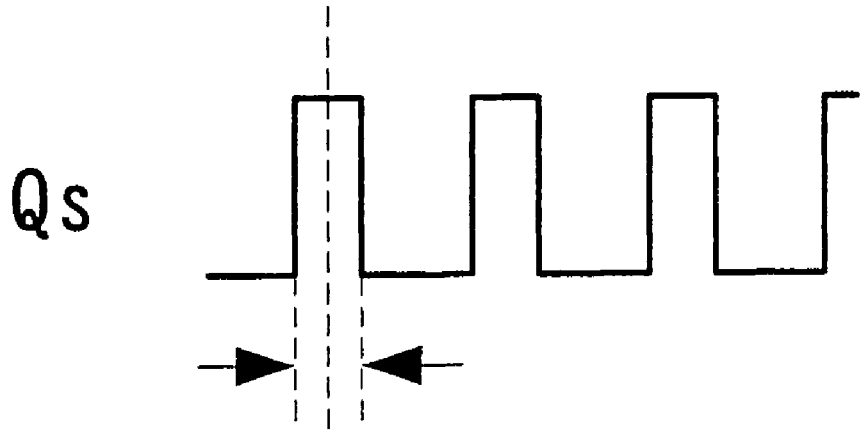
Figure 10D:
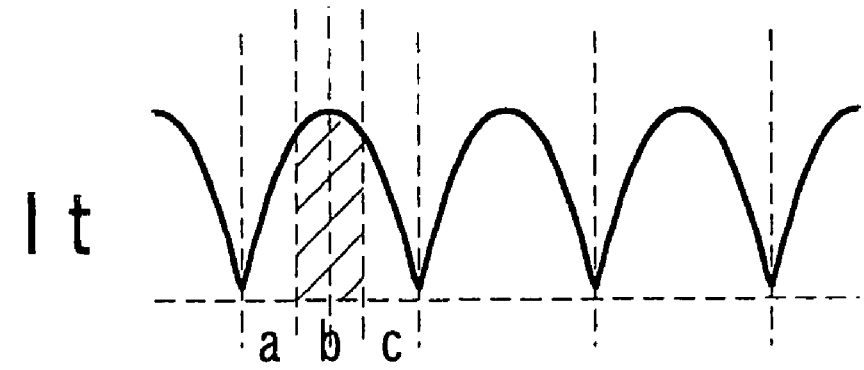
Figure 11:
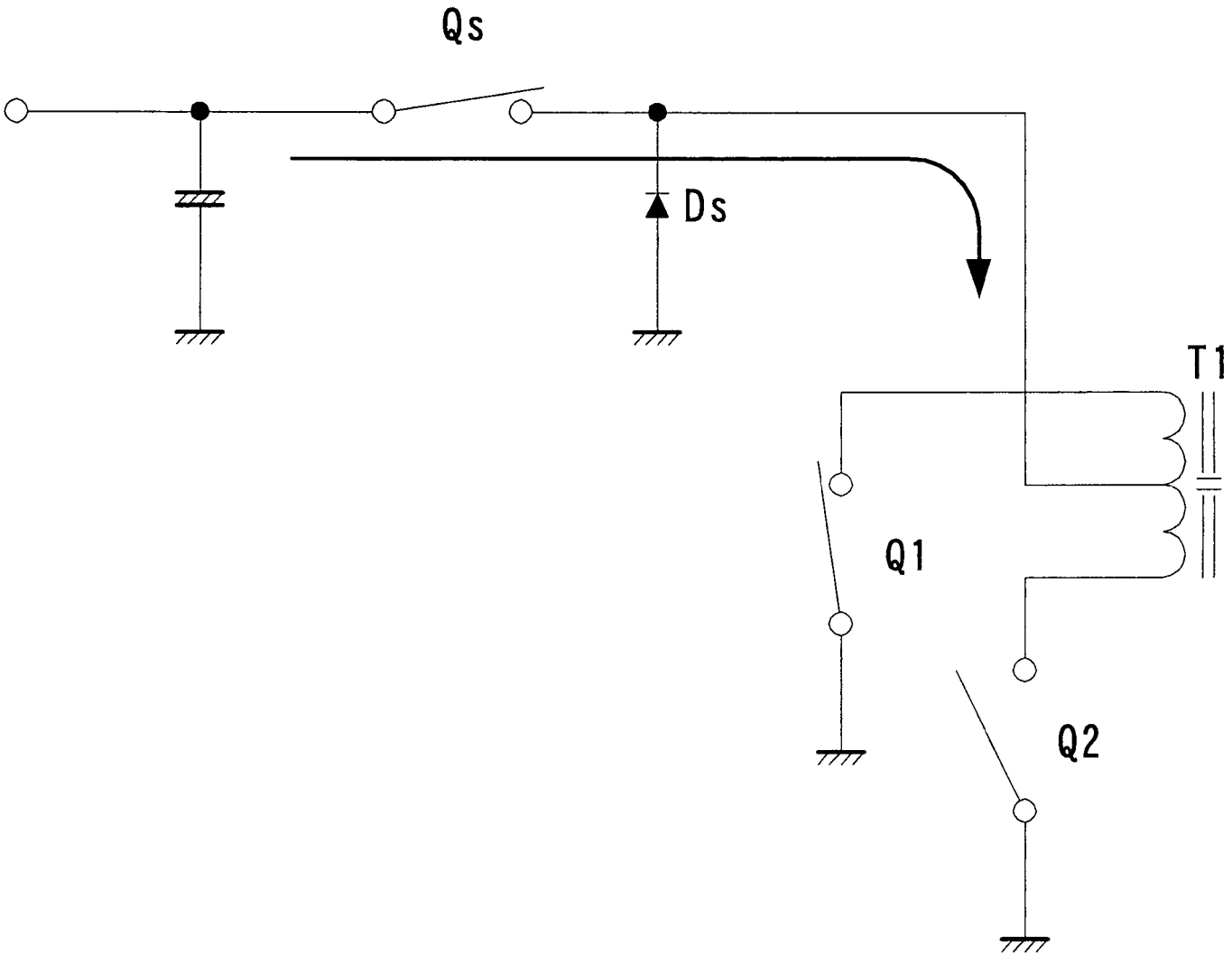
FIG. 11 is an equivalent circuit diagram showing a flow of a current when switching transistor Q2 is an ON state in Embodiment 3 of the present invention.

Making examination in detail, at timing indicated by b in FIG. 10D, i.e., when the switching transistor Qs is in an ON state, as shown in an equivalent circuit diagram of Fig. it showing a flow of the current when the switching transistor Qs is in the ON state, the current is caused to flow into the step-up transformer T1 through the switching transistor Qs.

Figure 12:
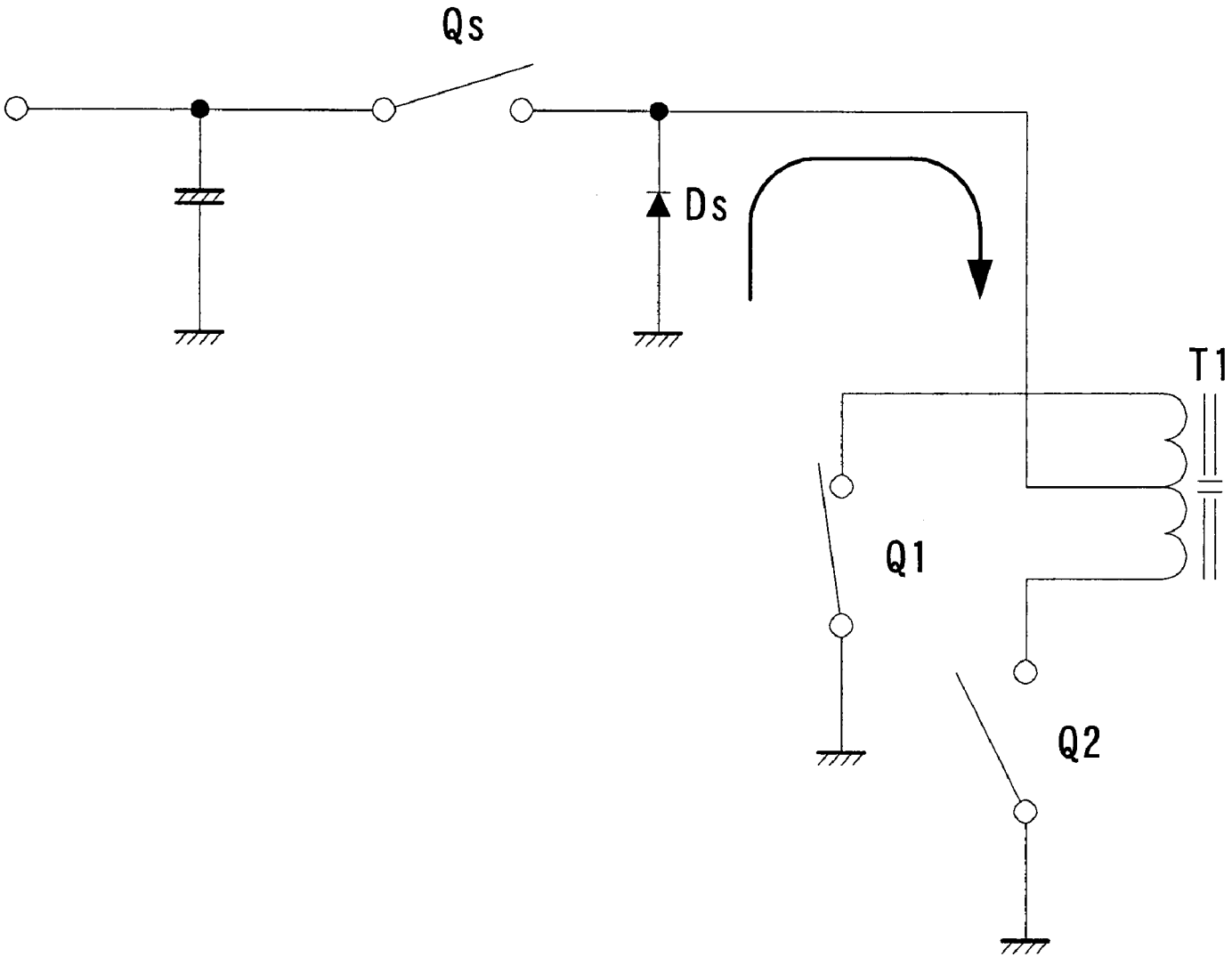
FIG. 12 is an equivalent circuit diagram showing a flow of a current when the switching transistor Q2 is an OFF state in Embodiment 3 of the present invention.

Next, when the switching transistor Qs is turned OFF at timing indicated by c, as shown in an equivalent circuit diagram of FIG. 12 showing a flow of the current when the switching transistor Qs Is in the OFF state, the current is caused to flow into the step-up transformer T1 through the fly-wheel diode Ds.

The current which is caused to flow in this case is not simple. FIG. 12 shows schematically a flow of the current to the utmost. Actually, a large oscillating current is often caused to flow through the primary winding of the step-up transformer.

Figure 13A:
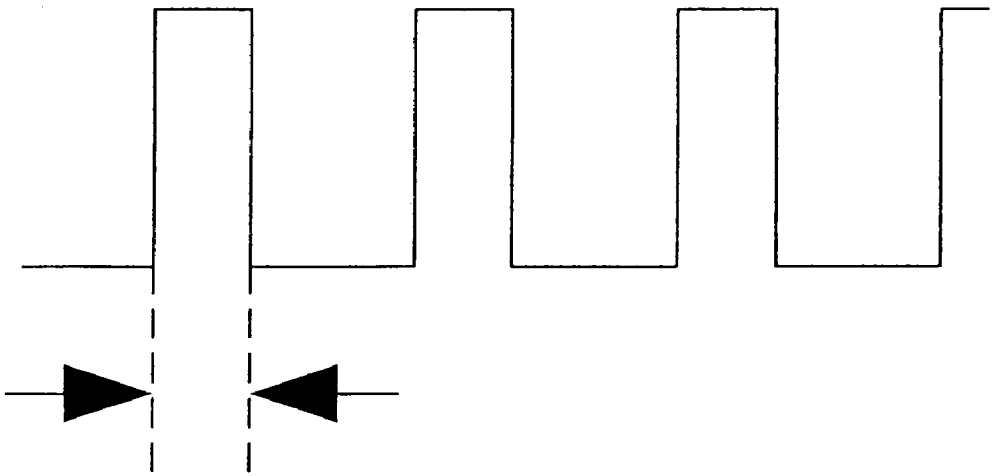
FIGS. 13A and 13B are waveform diagrams showing a situation of oscillation of a current at timing indicated by c shown in FIG. 10D.
Figure 13B:
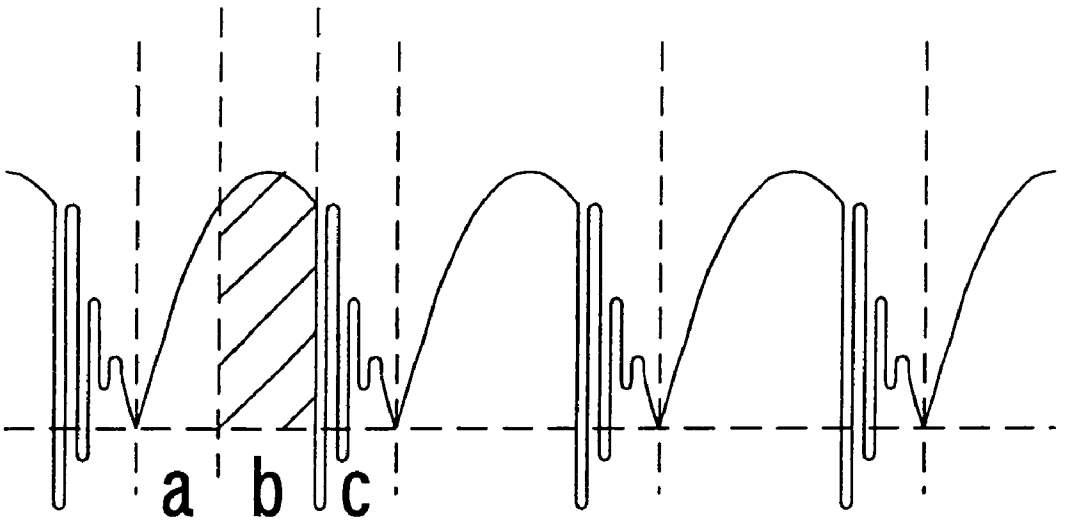

FIGS. 13A and 13B are waveform diagrams showing a situation of oscillation of the current at timing indicated by c shown in FIG. 10D.

Figure 14:
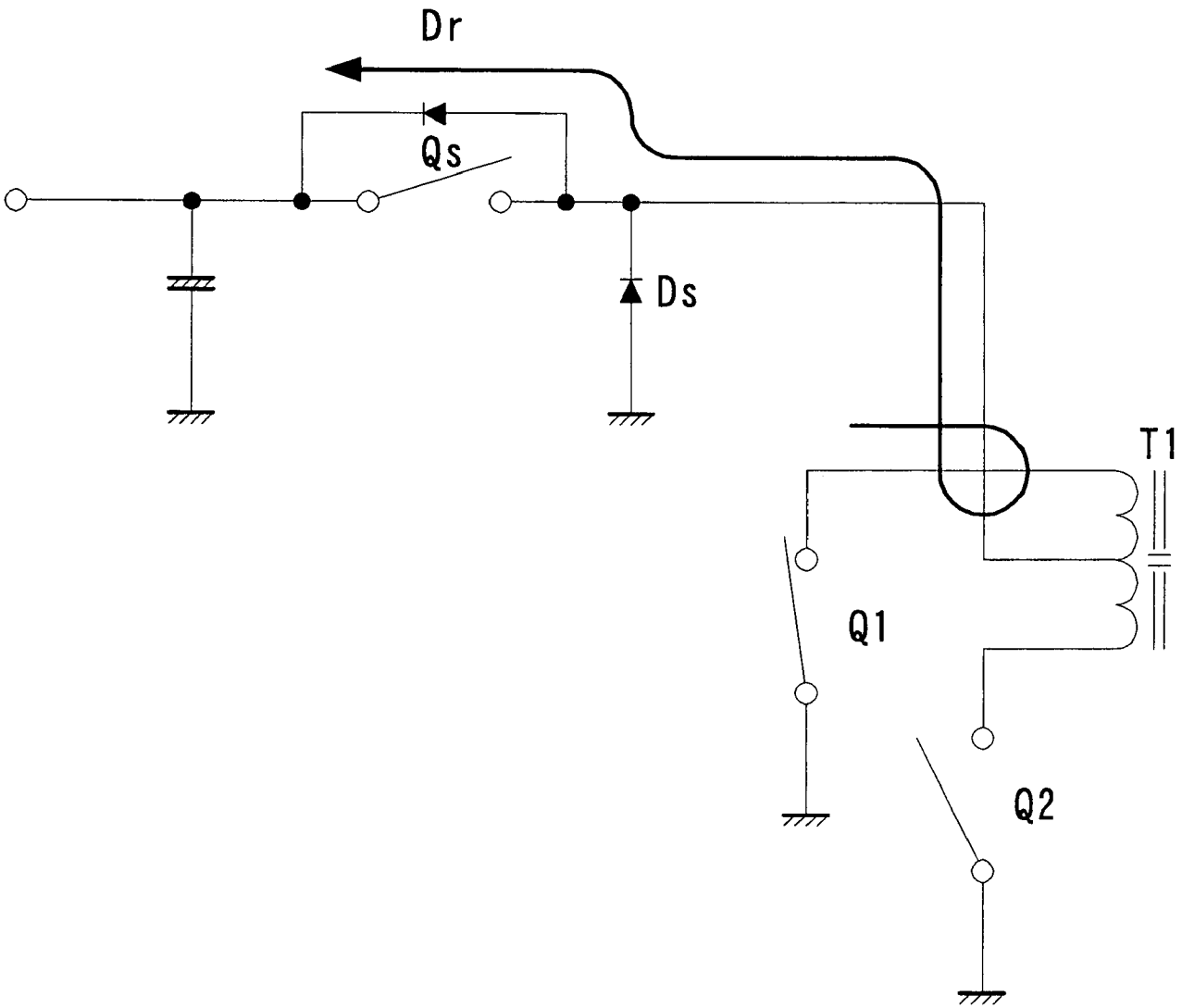
FIG. 14 is an equivalent circuit diagram explaining that an oscillating current which appears when the switching transistor Q2 is in the OFF state is regenerated in a power source in Embodiment 3 of the present invention.

While a cause of this oscillating current will be described later, in the present invention, when such an oscillating current is generated, the oscillating current which appears when the switching transistor Qs shown in FIG. 14 is in the OFF state is regenerated in the power source. As shown in an equivalent circuit diagram of FIG. 14, when the oscillation is caused, the current is caused to flow in the reverse direction through the switching transistor Qs, and regenerated in the power source through the regenerative diode Dr.

In other words, the same state as that in which the primary winding of the step-up transformer T1 is short-circuited is provided for the resonance current which is caused to flow in the forward direction, thereby preventing the energy of the resonance current from being lost. On the other hand, the oscillating current which is caused to flow in the reverse direction is regenerated in the power source, thereby damping the oscillation energy.

The dimming circuit using the conventional DC-DC converter includes no transistor for selectively damping only such a regenerative current. Thus, since the energy of the oscillating current is accumulated, the undesired current oscillation is caused in the primary winding.

Next, why such an oscillating current is generated will be described.

Figure 15:
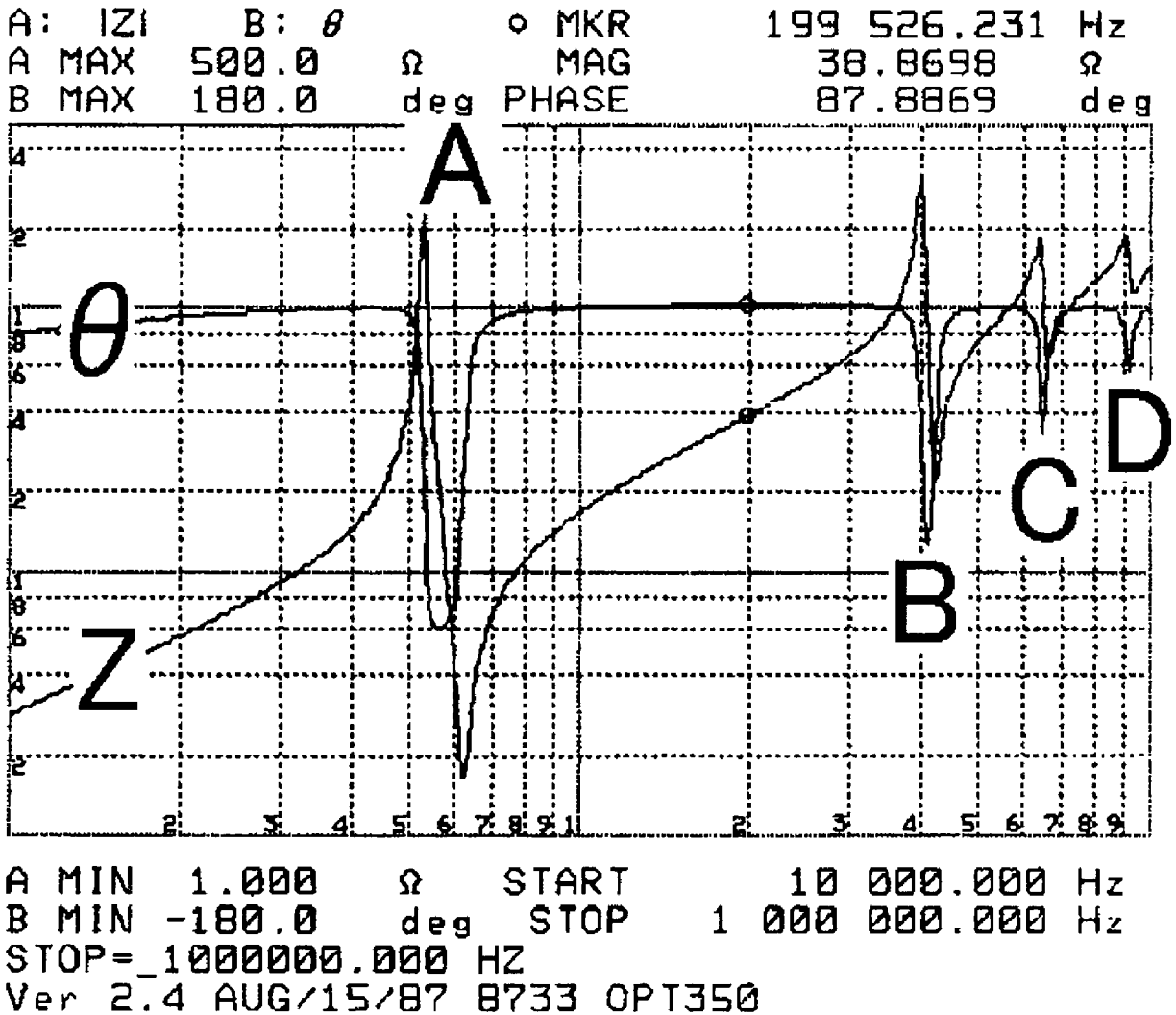
FIG. 15 is a graphical representation showing that many self-resonances exist on a secondary winding of a step-up transformer for a high voltage in Embodiment 3 of the present invention.

Many resonances exist on a secondary winding, of a transformer, having the large number of turns enough to generate a high voltage therein as in the step-up transformer for a cold cathode fluorescent lamp. When this situation is measured from the primary winding side with an impedance analyzer, a graph shown in FIG. 15 is obtained. FIG. 15 is a graphical representation explaining that many self-resonances exist on the secondary winding of the step-up transformer for a high voltage. A characteristic curve Z of FIG. 15 is obtained by measuring the impedance characteristics from the primary winding side. As apparent from the characteristic curve Z of FIG. 15, a plurality of resonances appear. The generation of such parasitic oscillations result from that the secondary winding of the step-up transformer is equivalently expressed in the form of a distributed constant circuit. Thus, the generation of such parasitic oscillations is caused by the various parasitic oscillations generated on the secondary winding of the transformer for a high voltage such as the transformer of the inverter circuit for a cold cathode fluorescent lamp.

In FIG. 15, a resonance indicated by A is one called the generally well known self-resonance of the transformer. However, while not generally known so much, self-resonances indicated by B, C and D also exist. Of these self-resonances, the self-resonance indicated by B has a large energy and thus may appear in the form of a current oscillation on the primary winding side. Such current oscillations are described as "the undesired resonances" in Japanese Unexamined Patent Publication No. Sho 56-88678 as well, etc.

Figure 16:
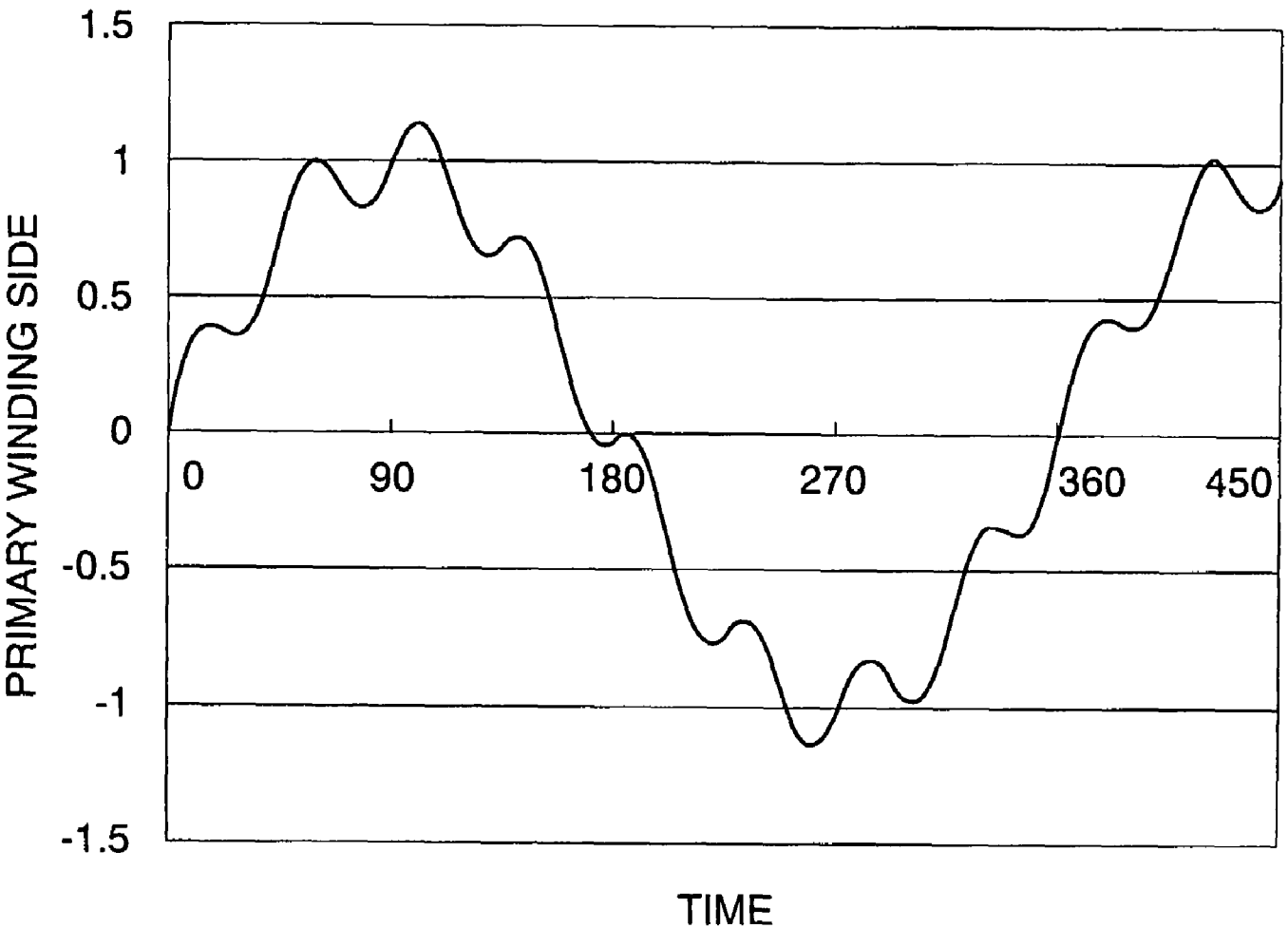
FIG. 16 is a graphical representation showing a situation of an oscillating current generated in a primary winding of a step-up transformer for a cold cathode fluorescent lamp in Embodiment 3 of the present invention.
Figure 17:
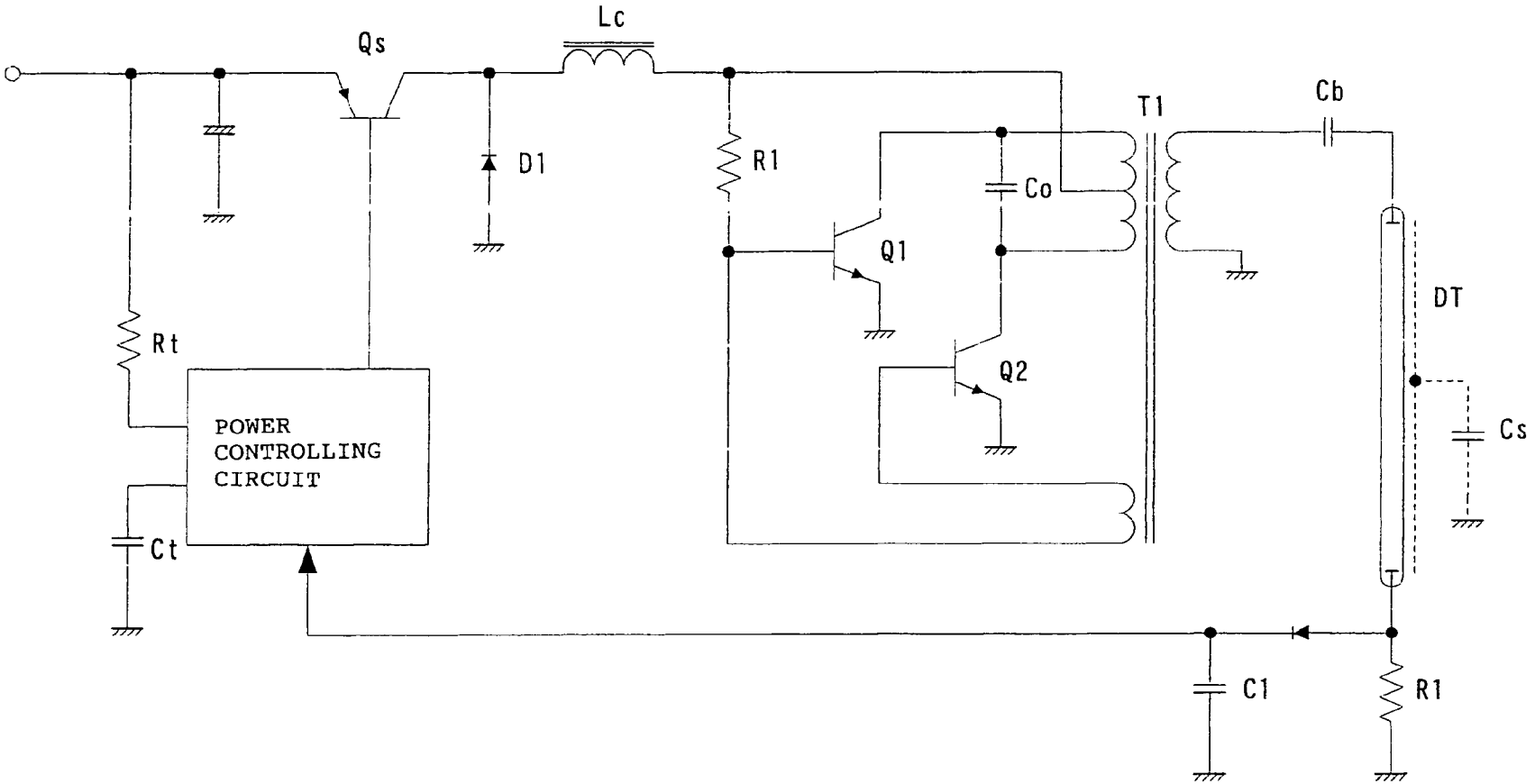
Fig. 17 Background Art
FIG. 17 is an equivalent circuit diagram of a collector resonance type circuit used as a conventional inverter circuit for a cold cathode fluorescent lamp.
Figure 18:
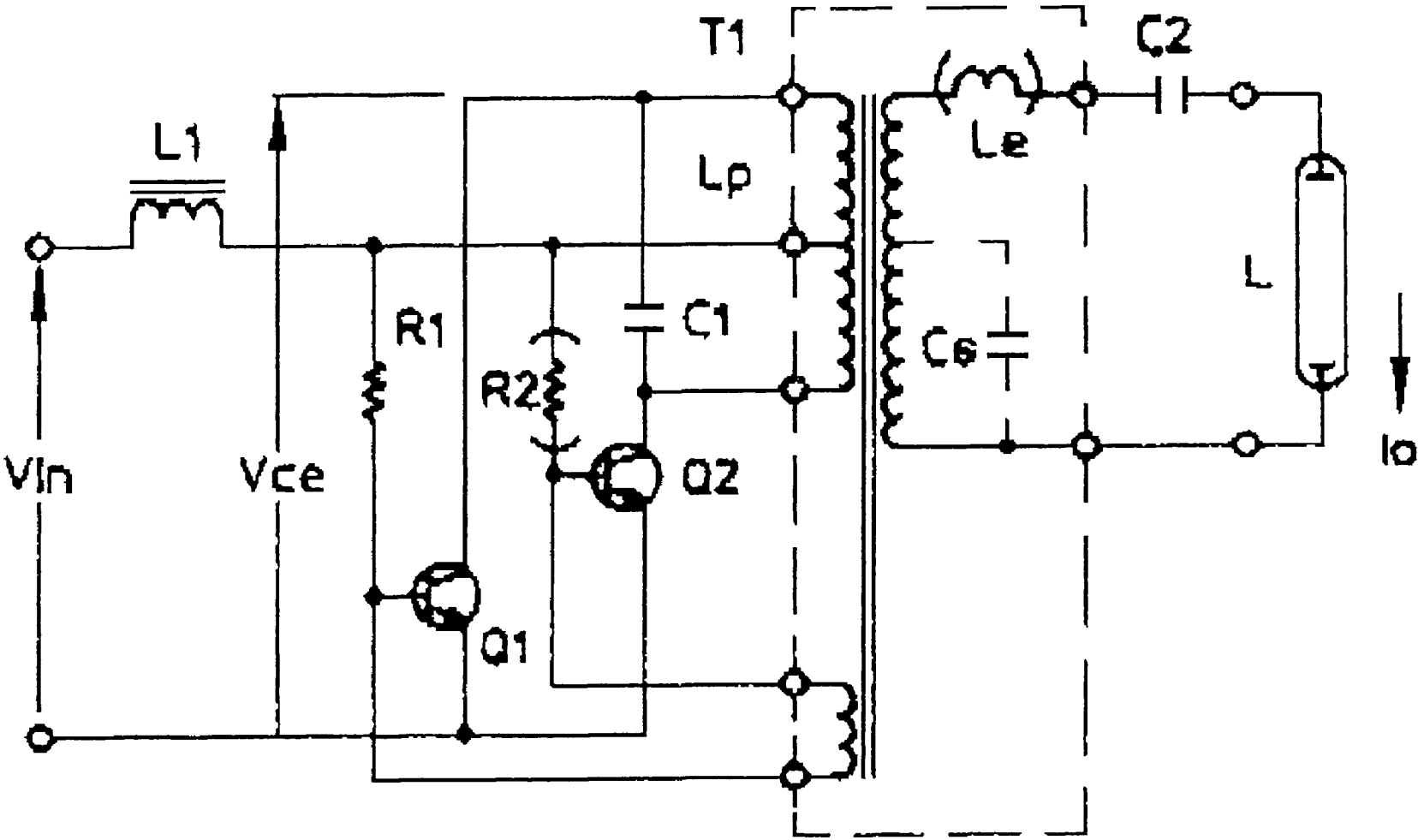
Fig. 18 Background Art
FIG. 18 is an equivalent circuit diagram of a conventional inverter circuit for a cold cathode fluorescent lamp.
Figure 19:
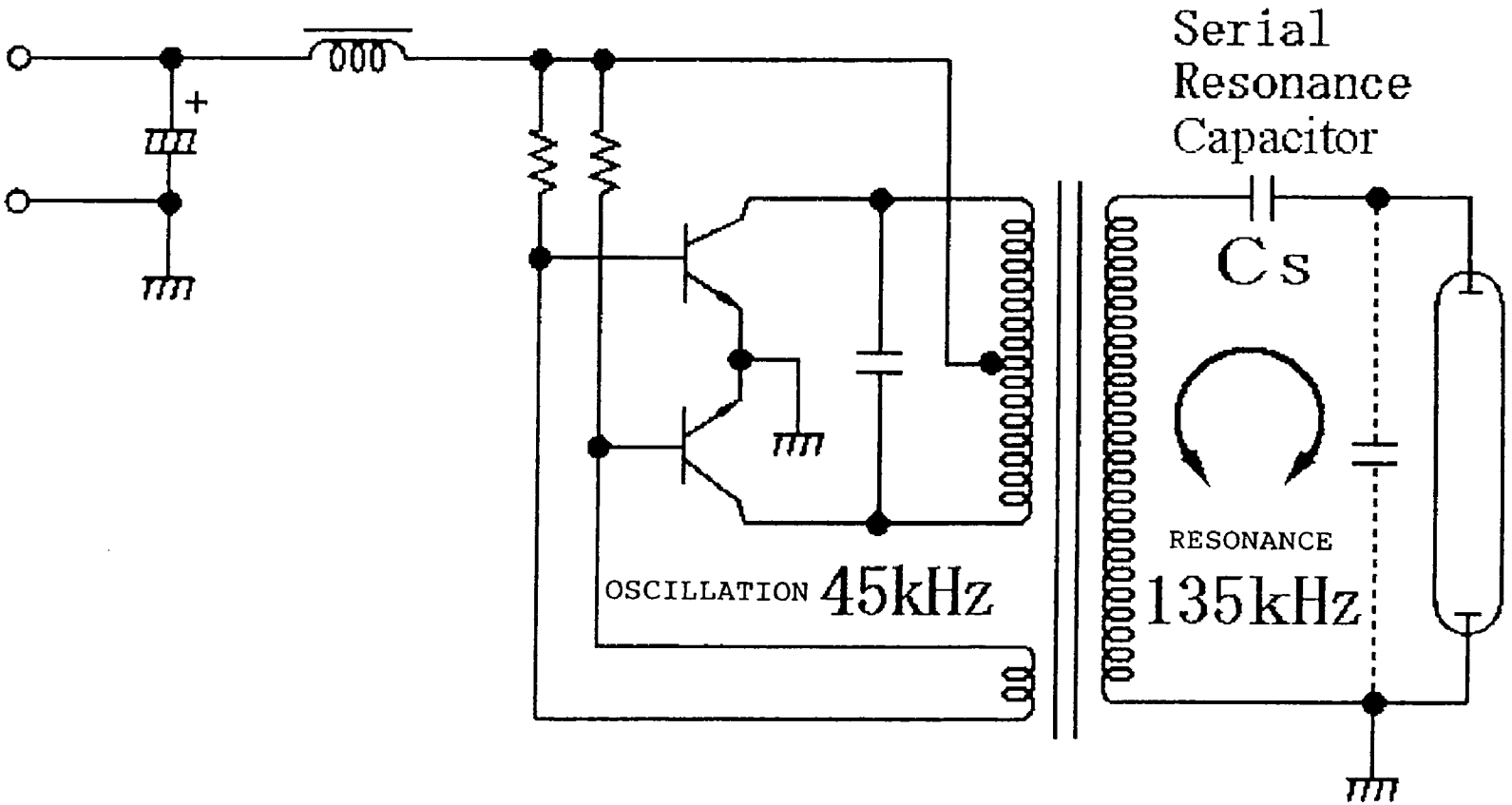
Fig. 19 Background Art
FIG. 19 is an equivalent circuit diagram explaining that a resonance frequency of a secondary side circuit is 3 times as high as an oscillation frequency of a primary side circuit in the conventional inverter circuit for a cold cathode fluorescent lamp.
Figure 20A:
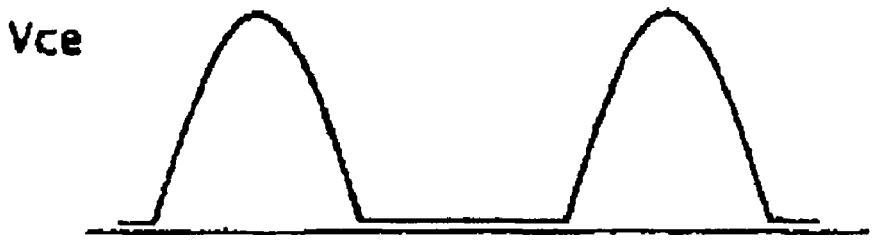
Fig. 20A Background Art
FIGS. 20A to 20D are waveform diagrams showing that an oscillation frequency and a third-order harmonics are composed with each other to generate a composite signal having a trapezoid waveform in the conventional inverter circuit for a cold cathode fluorescent lamp.
Figure 20B:
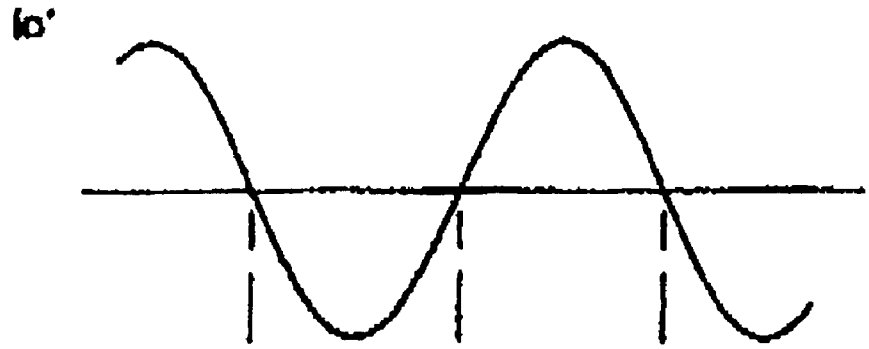
Fig. 20B Background Art
Figure 20C:
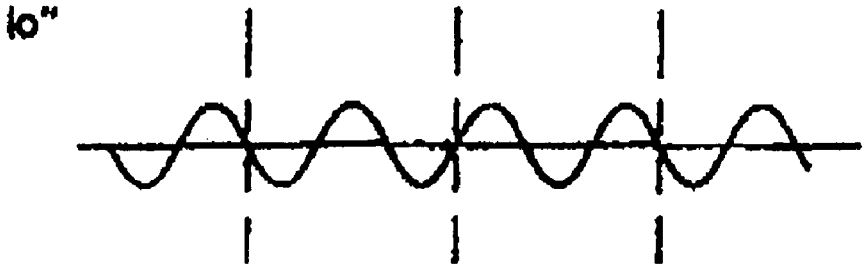
Fig. 20C Background Art
Figure 20D:
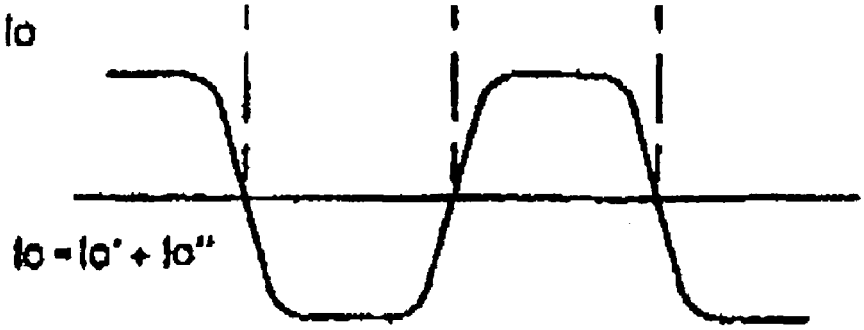
Fig. 20D Background Art
Figure 21:
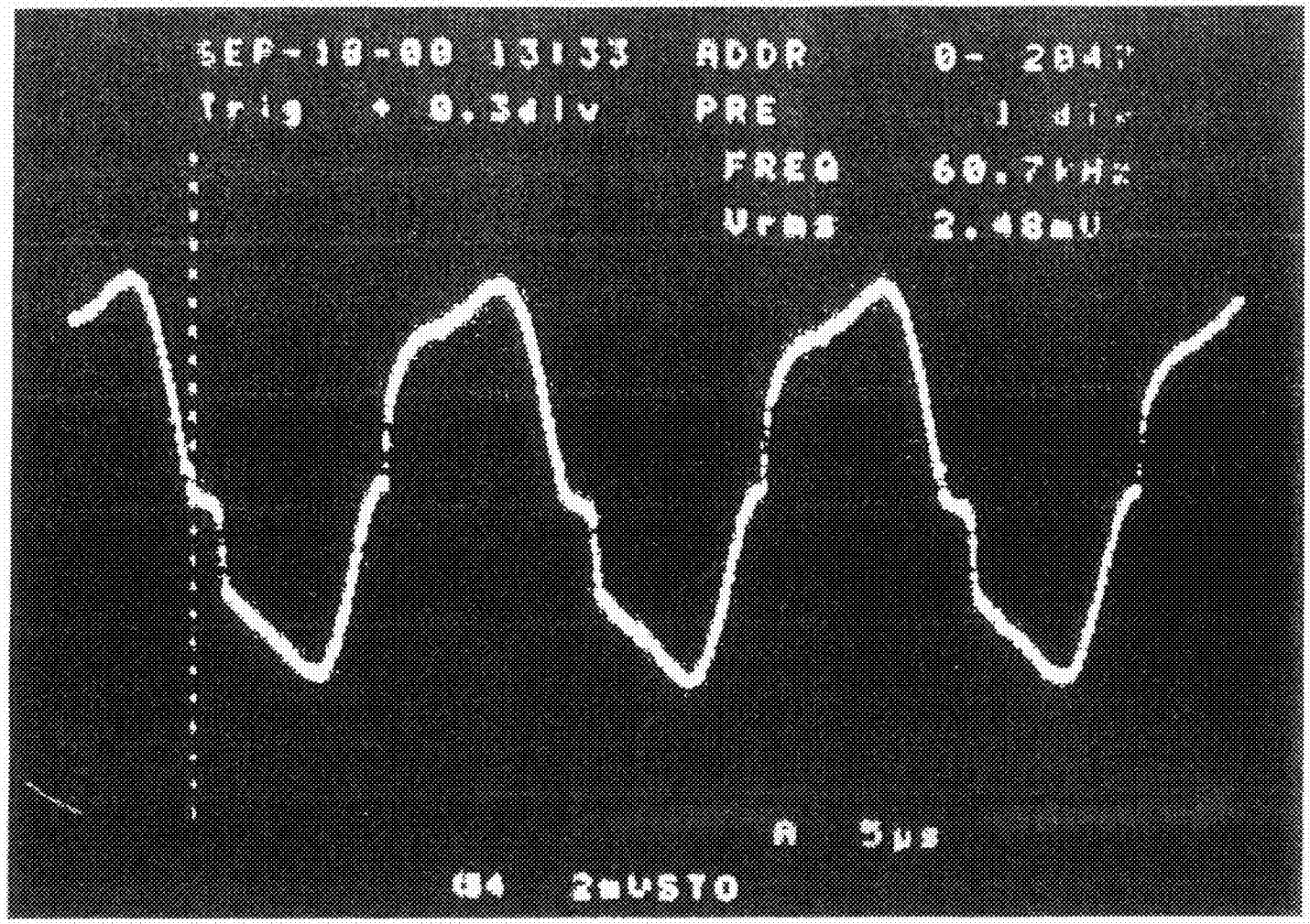
Fig. 21 Background Art
FIG. 21 is a waveform diagram showing a waveform of a current which is caused to flow through a cold cathode fluorescent lamp of the conventional so-called three-time resonance type circuit.
Figure 22A:
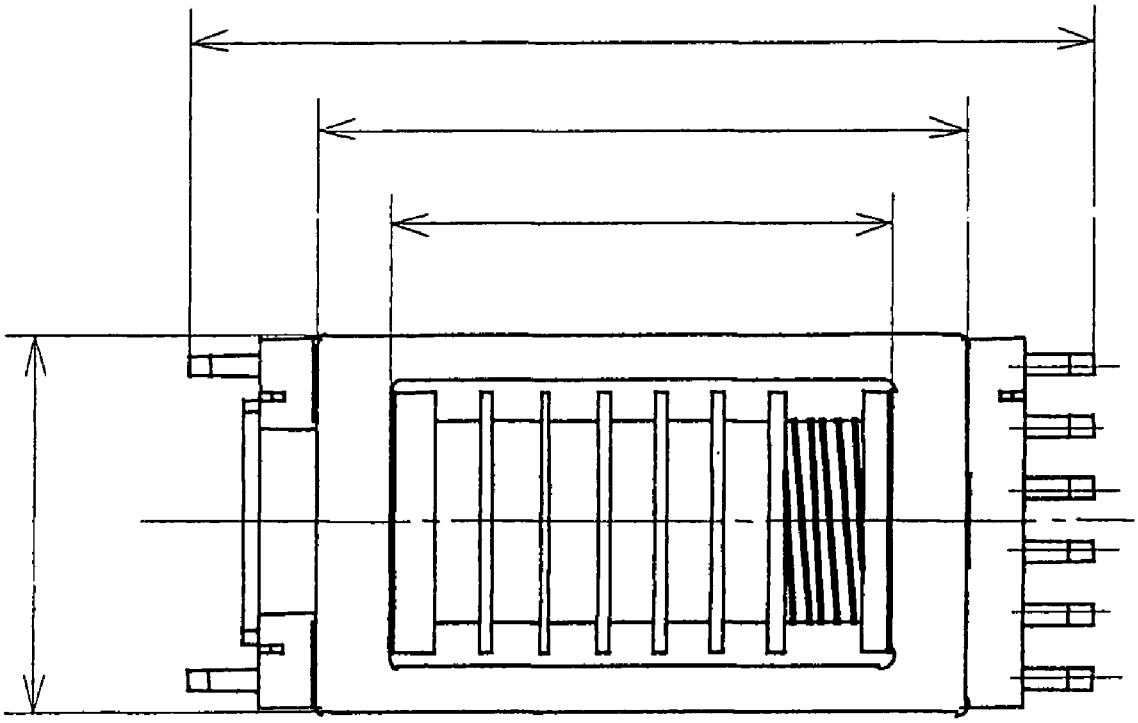
Fig. 22A Background Art
FIGS. 22A and 22B are views explaining a transformer which has much magnetic flux leakage in a closed magnetic path structure and which is used in the conventional so-called three-time resource.
Figure 22B:
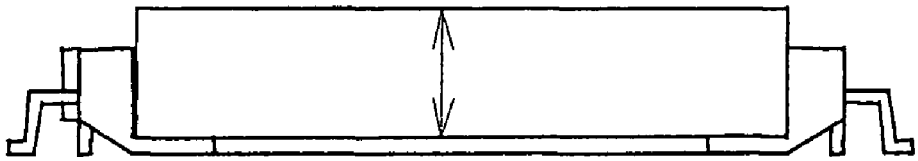
Fig. 22B Background Art
Figure 23:
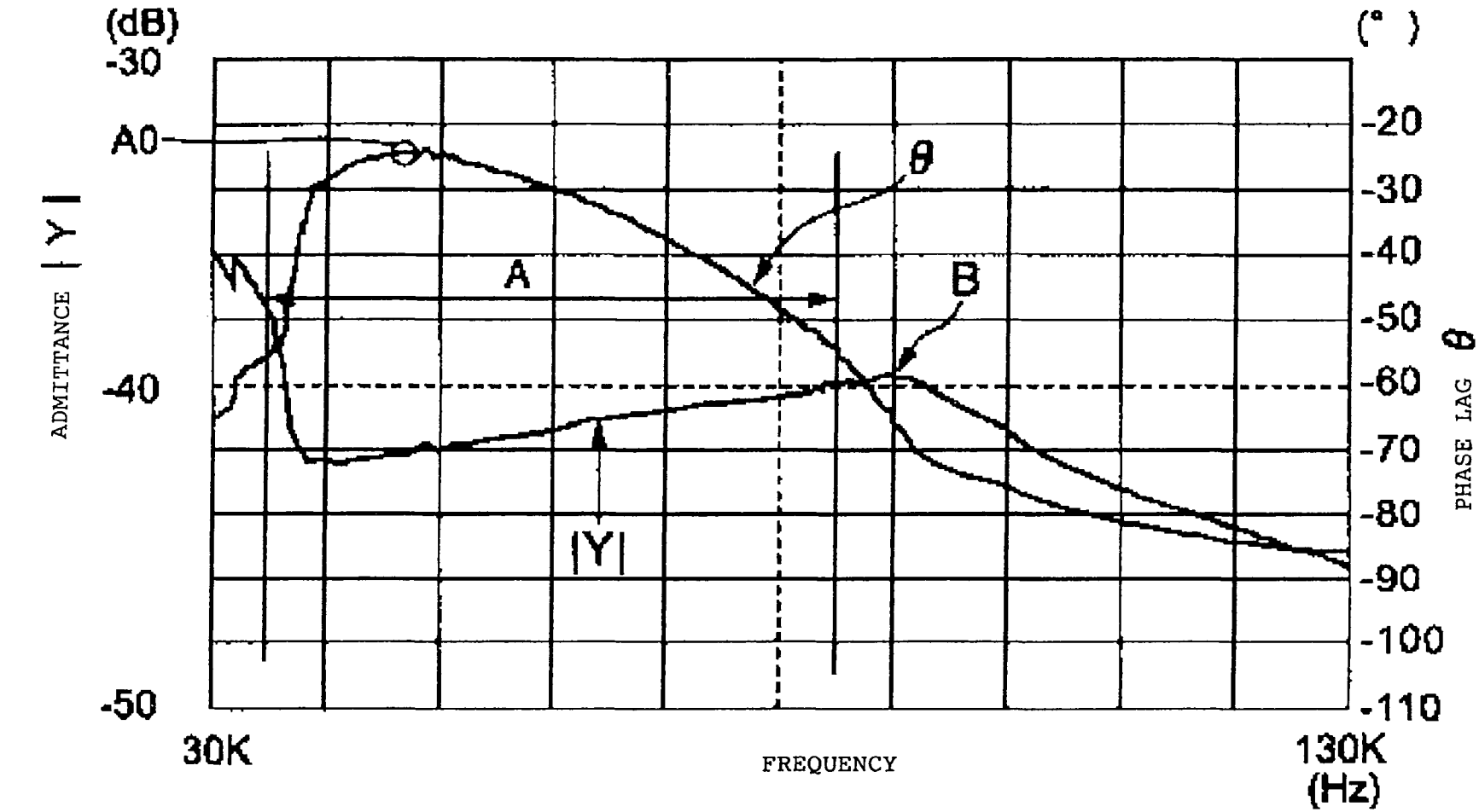
Fig. 23 Background Art
FIG. 23 is a graphical representation explaining a technique for improving a power factor when viewed from a driving transistor side of the conventional inverter circuit for a cold cathode fluorescent lamp.
Figure 24:
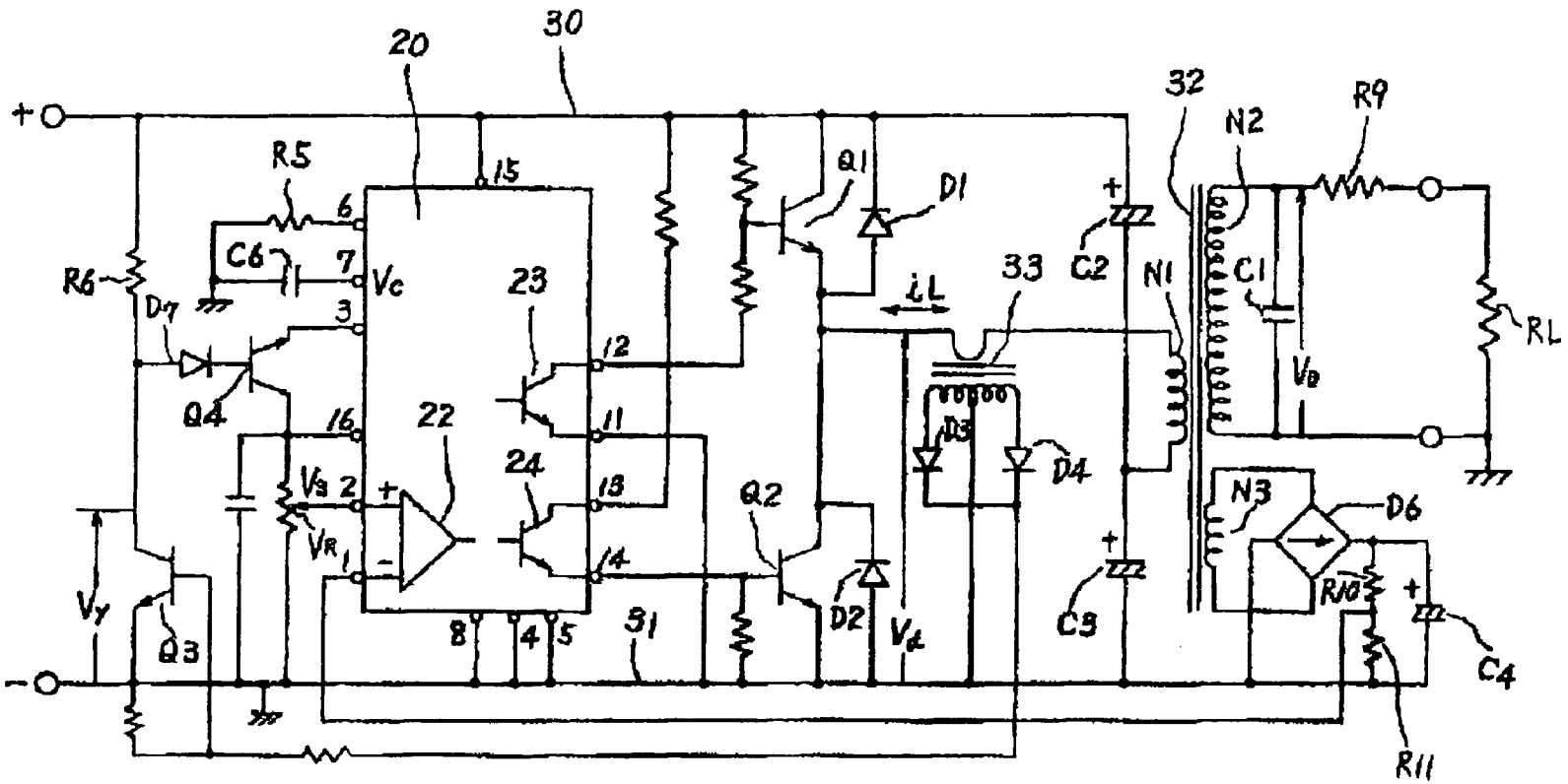
Fig. 24 Background Art
FIG. 24 is a circuit diagram of a zero current switching type circuit in the conventional inverter circuit.
Figure 25A:
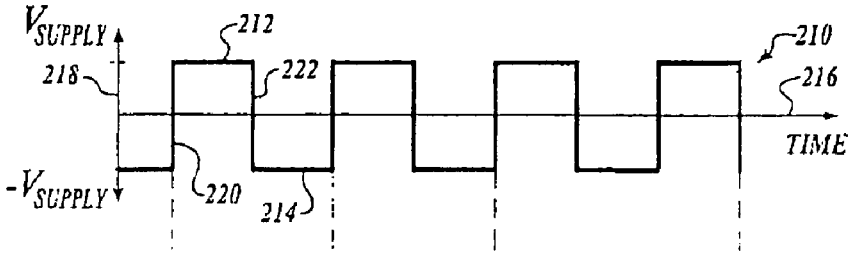
Fig. 25A Background Art
FIGS. 25A to D are waveform diagrams explaining an operation of the conventional zero current switching type circuit.
Figure 25B:
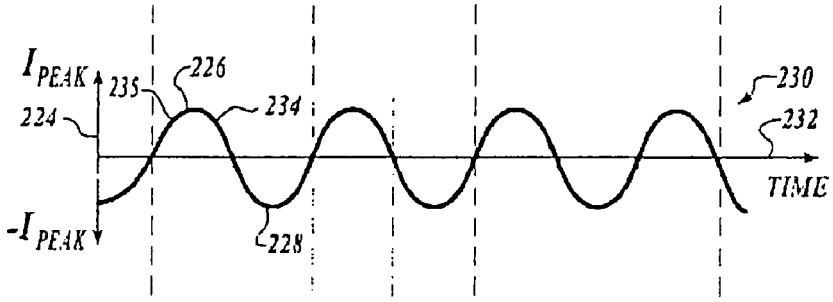
Fig. 25B Background Art
Figure 25C:
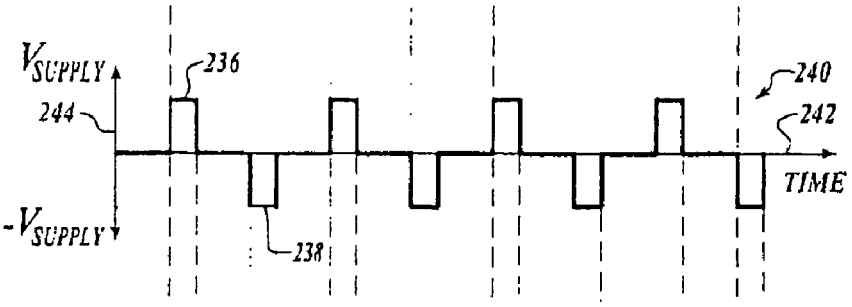
Fig. 25C Background Art
Figure 25D:
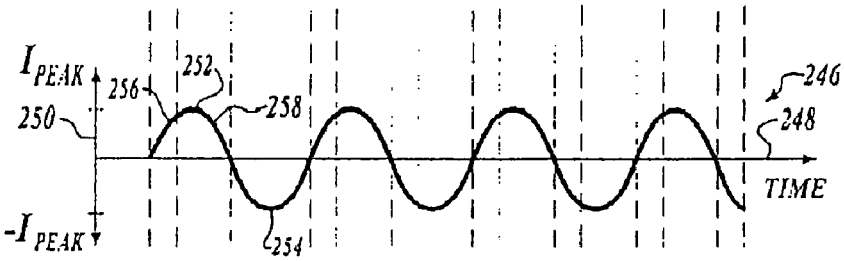
Fig. 25D Background Art
Figure 26E:
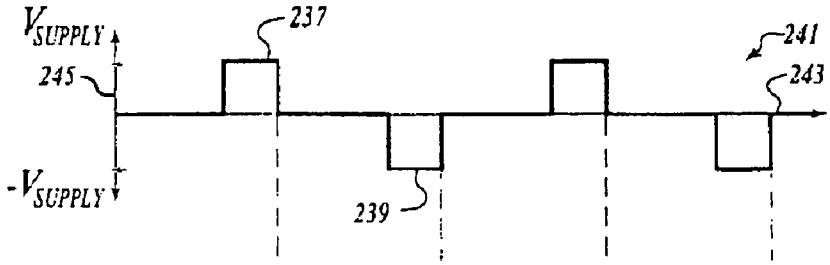
Fig. 26E Background Art
FIGS. 26E, F, AA, and BB are waveform diagrams explaining an example of control which is not performed for a conventional zero current switching operation.
Figure 26F:
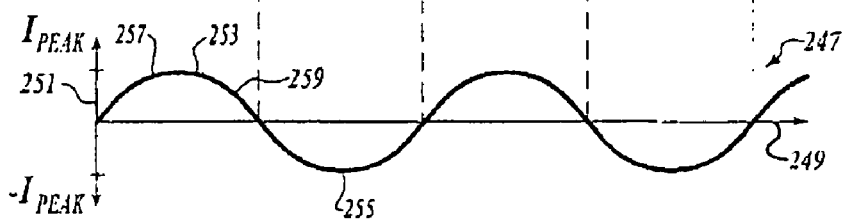
Fig. 26F Background Art
Figure 26A:
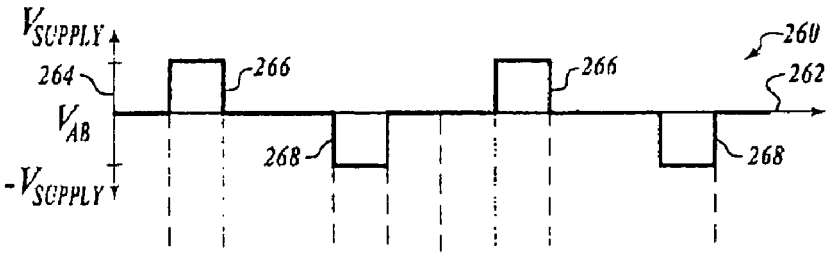
Fig. 26AA Background Art
Figure 26B:
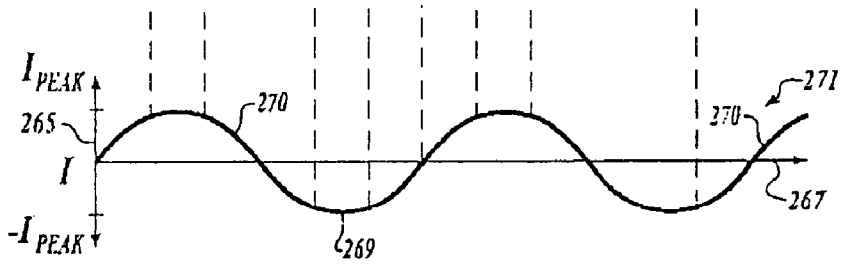
Fig. 26BB Background Art
Figure 27:
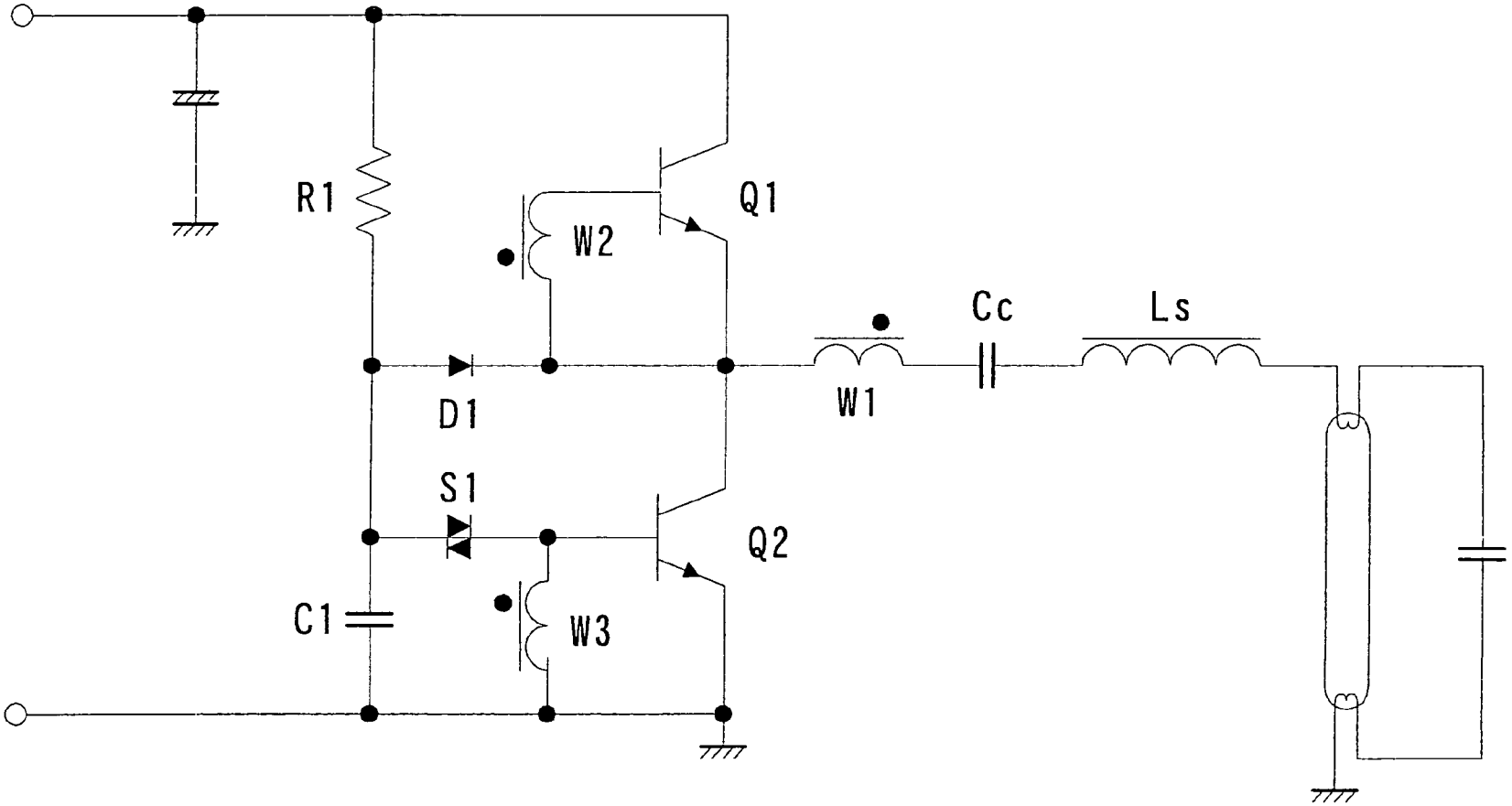
Fig. 27 Background Art
FIG. 27 is a circuit diagram of a conventional current resonance type circuit for a hot cathode lamp.
Figure 28:
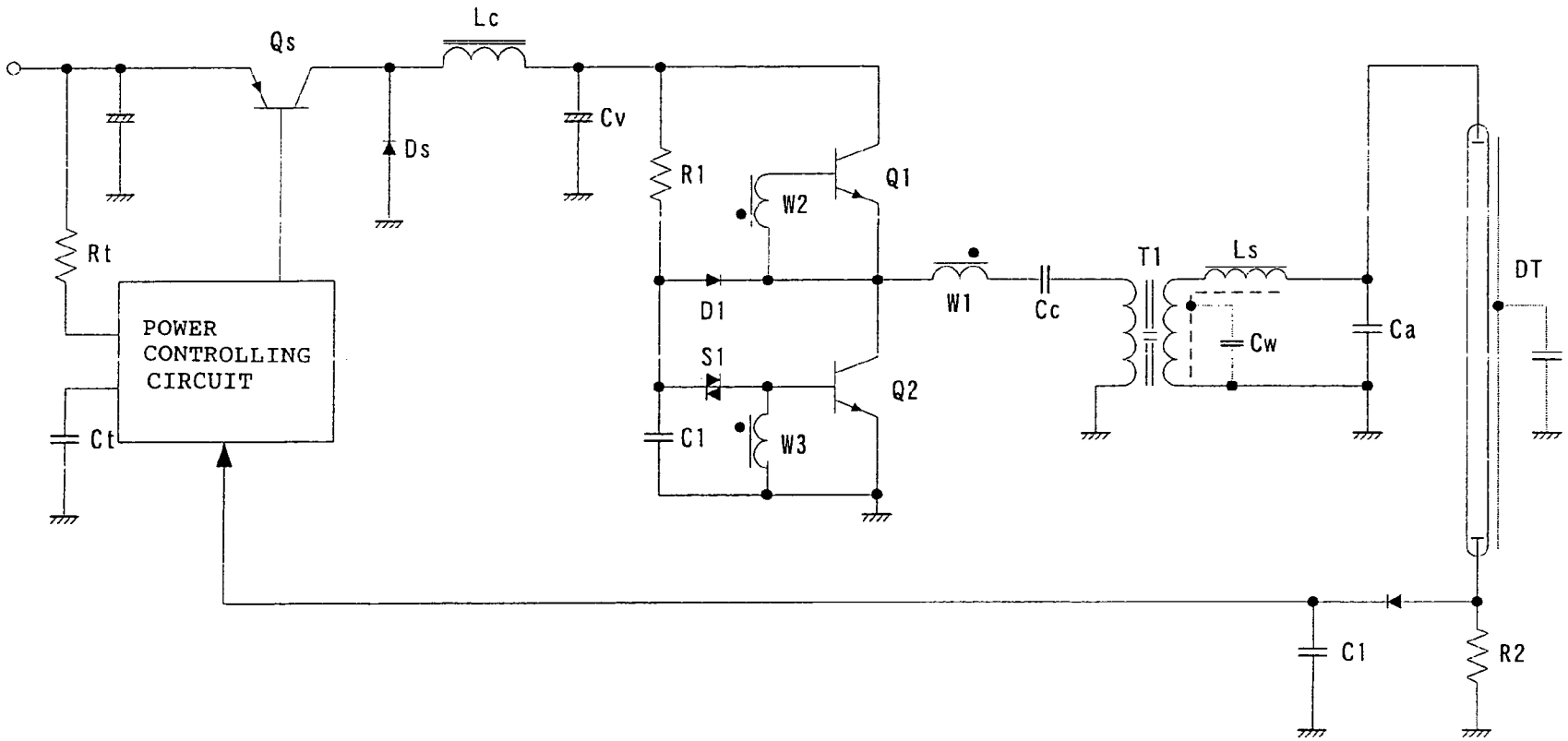
Fig. 28 Background Art
FIG. 28 is a circuit diagram of an example of a dimming circuit of an inverter circuit for a cold cathode fluorescent lamp in which a conventional current resonance type circuit and a DC-DC converter circuit provided in a preceding stage thereof are combined with each other.
Figure 29:
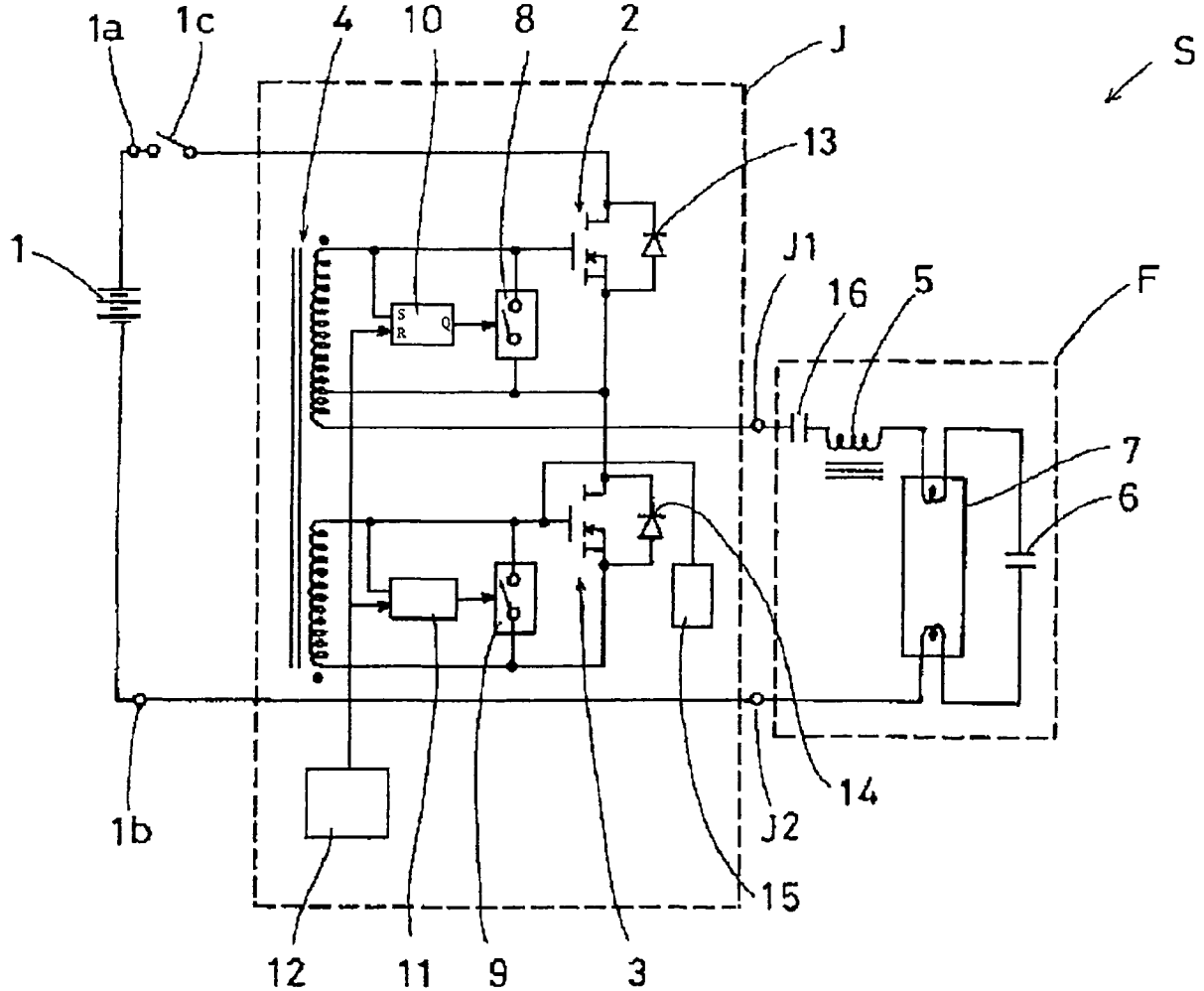
Fig. 29 Background Art
FIG. 29 is a circuit diagram of a dimming circuit which the inverter of the present invention disclosed in the invention of Japanese Unexamined Patent Publication No. Hei 8-288080.
Figure 30:
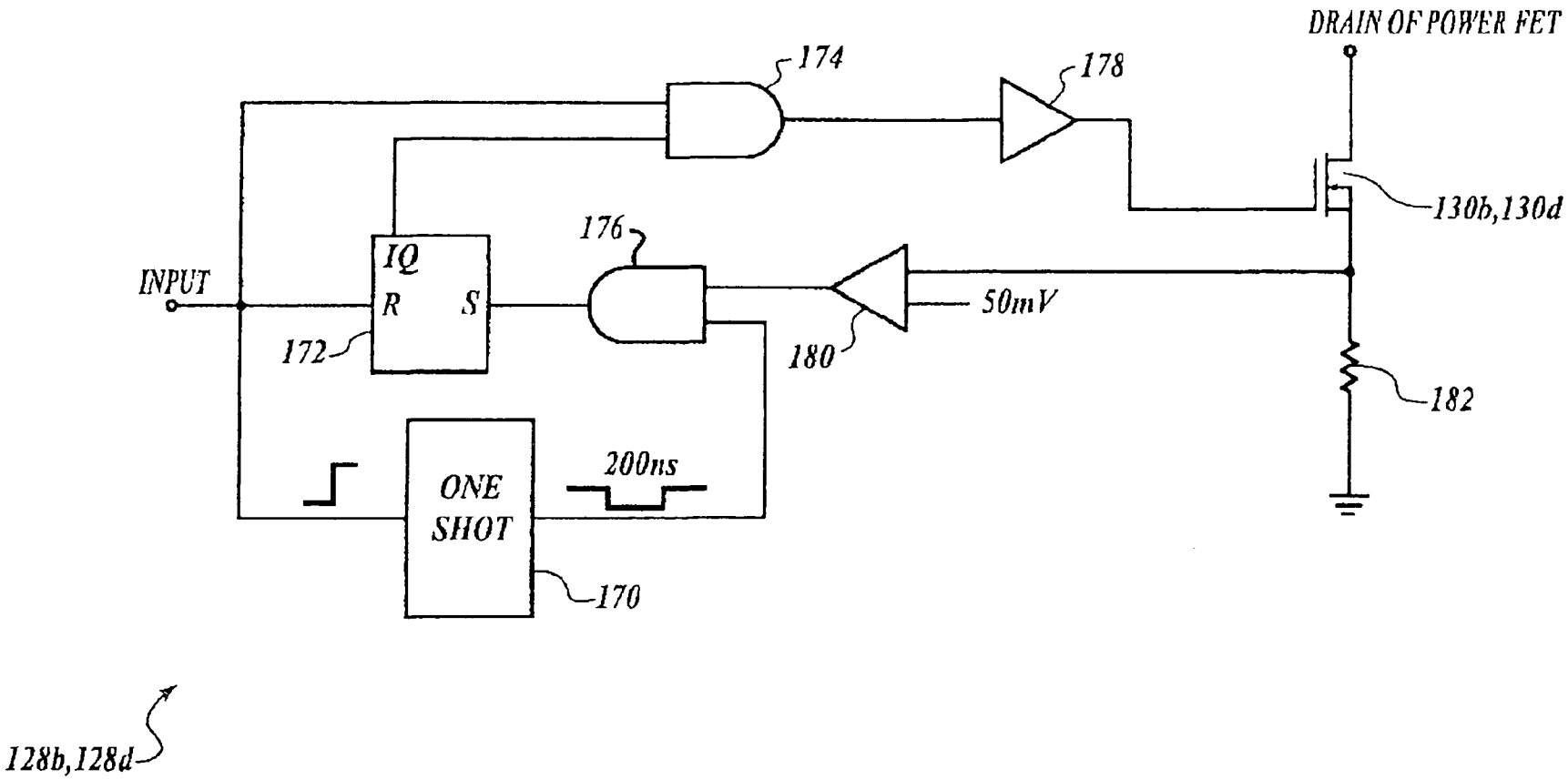
Fig. 30 Background Art
FIG. 30 is a circuit diagram of a dimming circuit disclosed in FIG. 9 of U.S. Pat. No. 6,114,814-B1.
Figure 31:
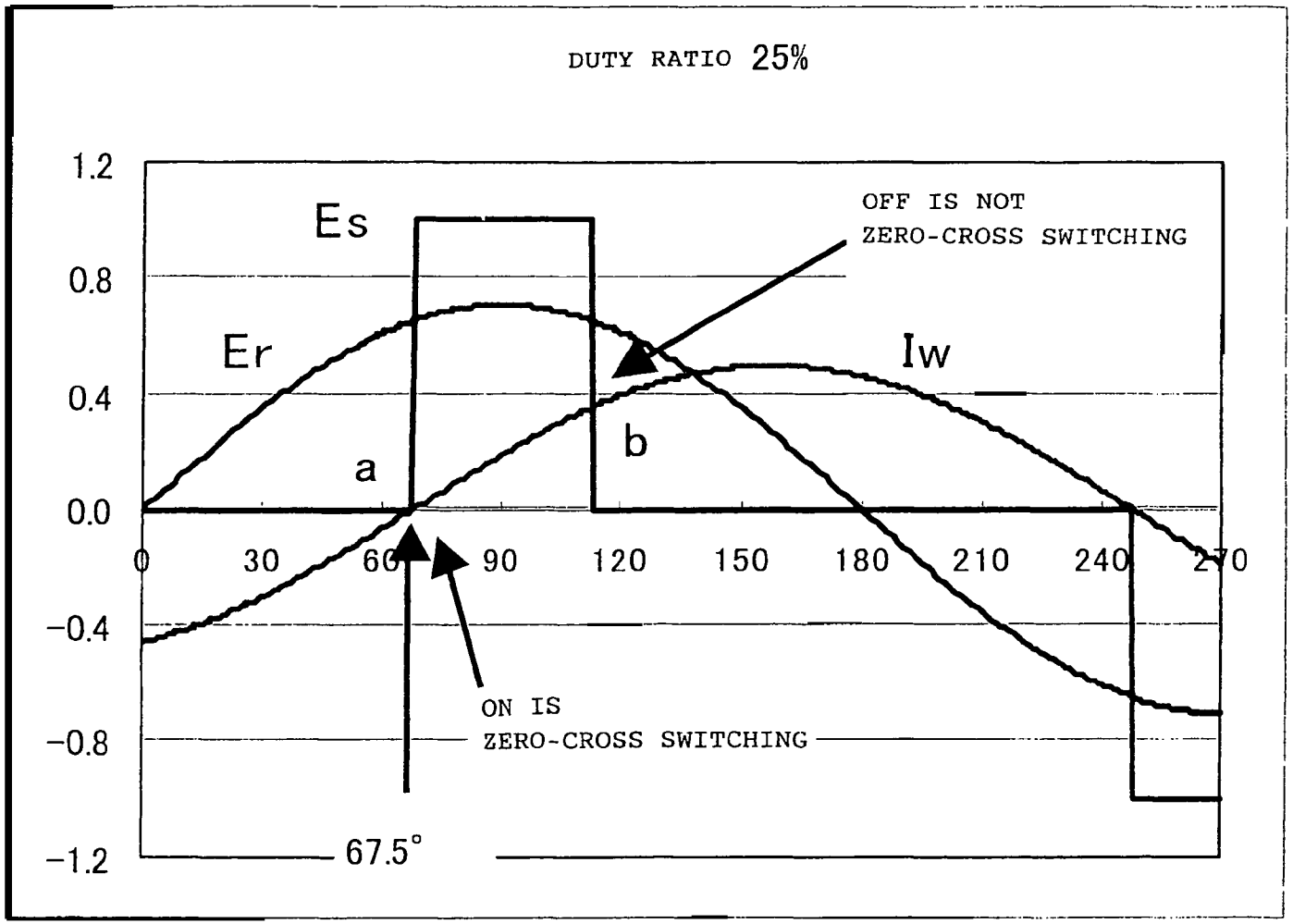
Fig. 31 Background Art
FIG. 31 is a waveform diagram explaining a relationship between waveforms of a voltage and a current in a primary winding of a transformer in conventional zero current switching method and an effective voltage value in the primary winding thereof, and their phases.
Figure 32:
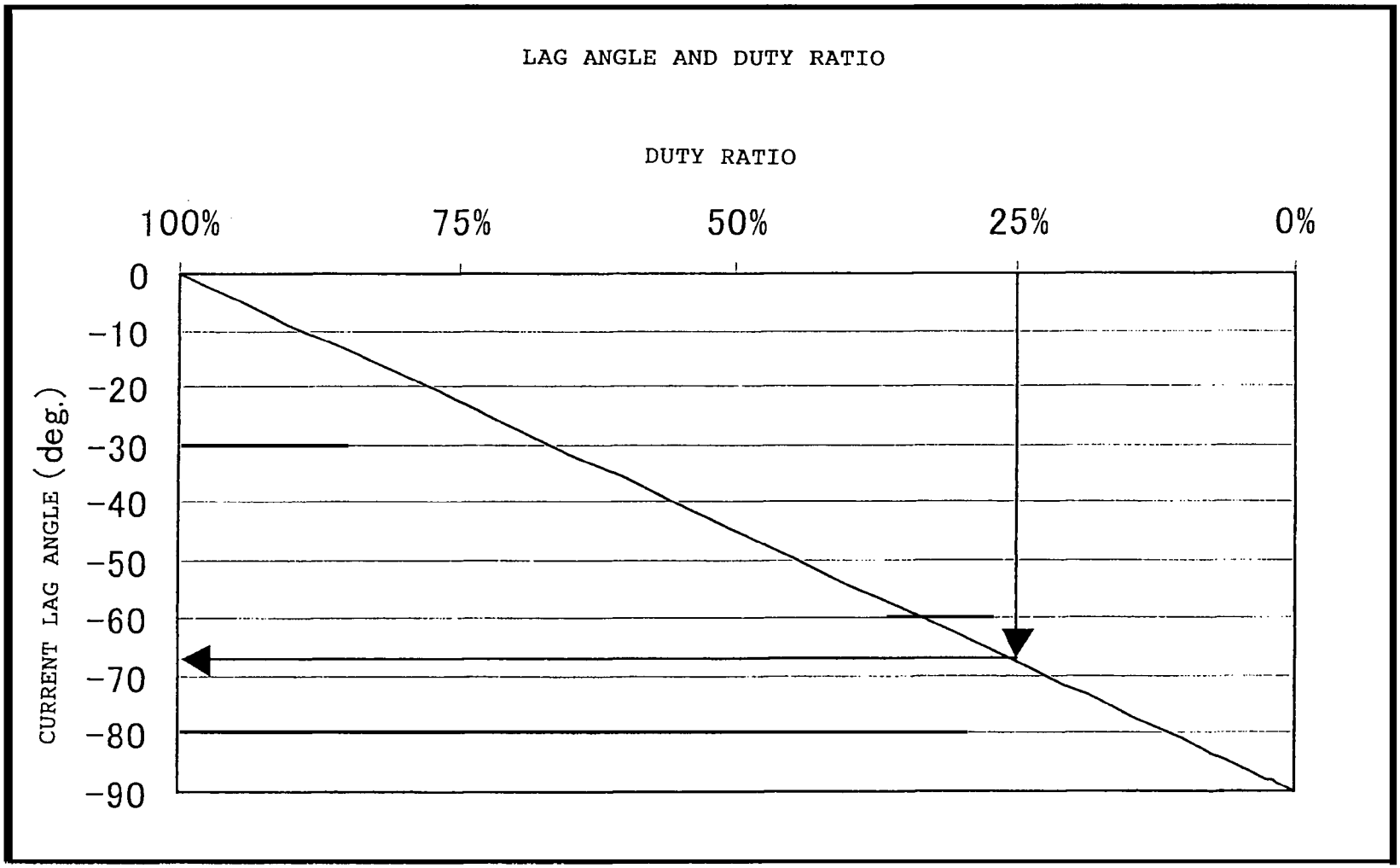
Fig. 32 Background Art
FIG. 32 is a graphical representation obtained by calculating how the phase of the effective voltage value and the phase of the current change along with a change in flow angle in the conventional zero current switching method.
Figure 33:
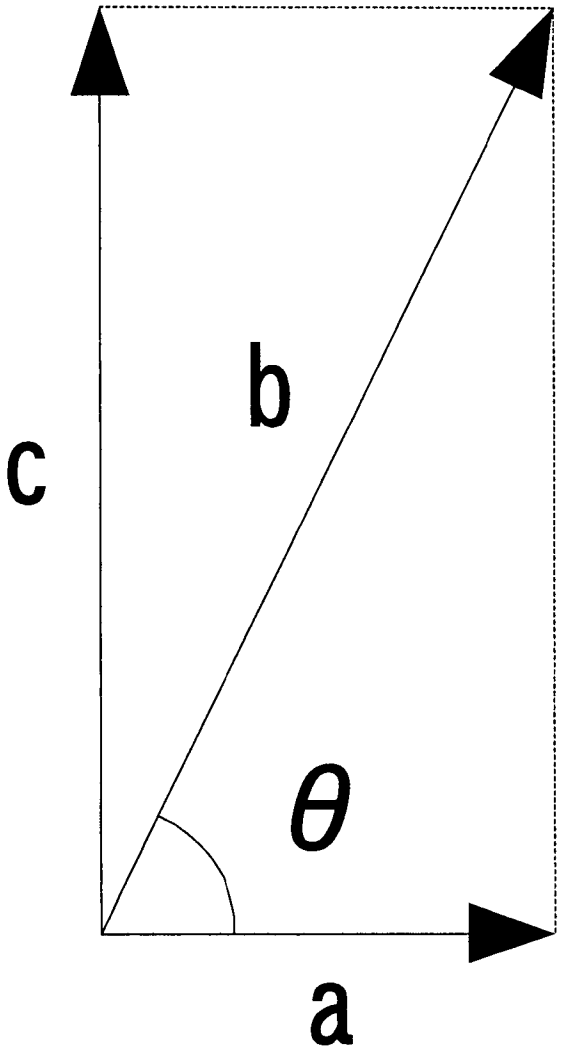
FIG. 33 is an explanatory diagram showing a relationship among a load current obtained through primary side conversion, an exciting current, and a current caused to flow through the primary winding when a power factor in the conventional zero current switching method is examined.
Figure 34:
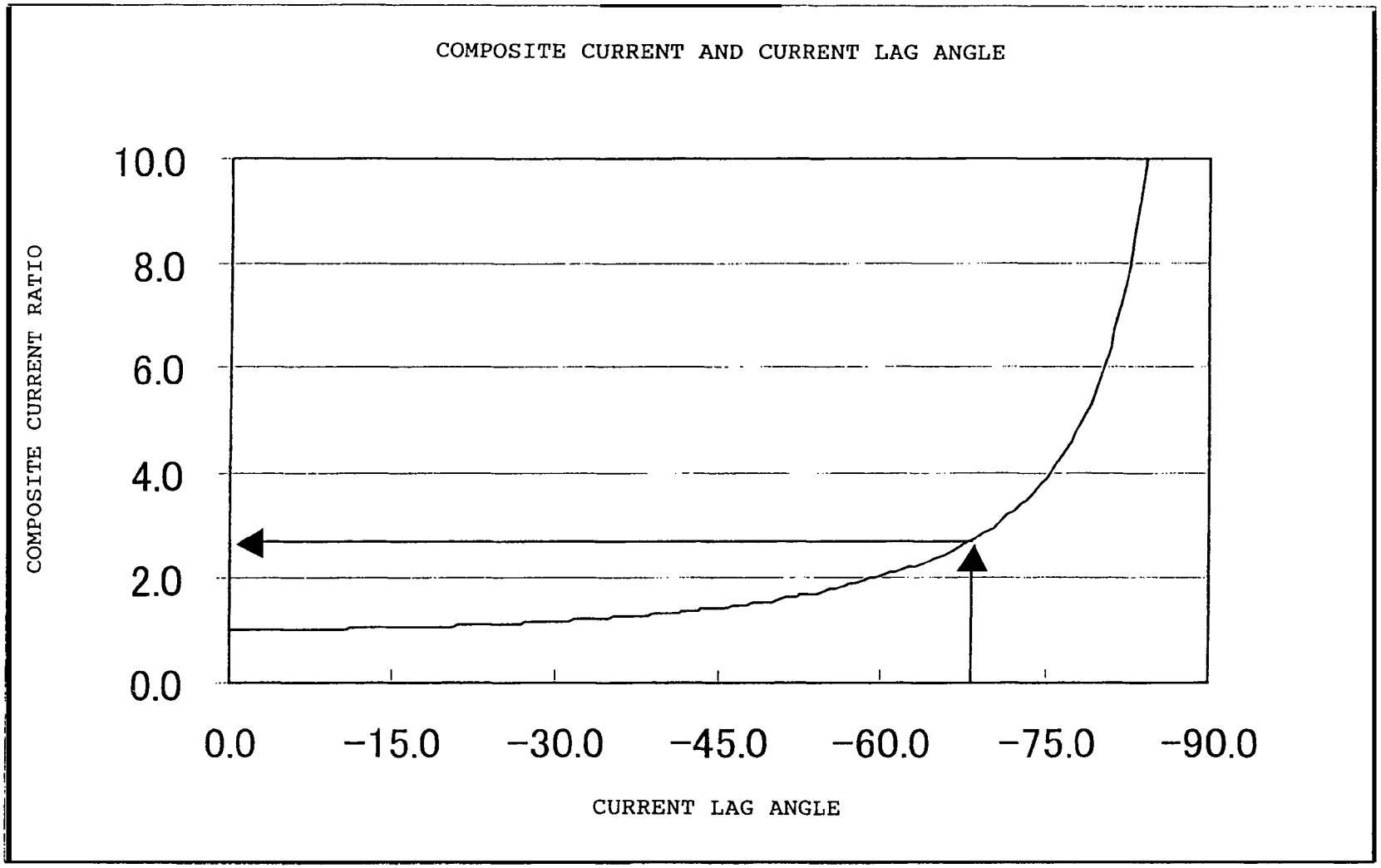
Fig. 34 Background Art
FIG. 34 is a graphical representation explaining that when a lag angle in the conventional zero current switching method is 67.5 degrees, the much exciting current is caused to flow and thus the current of the primary winding becomes 2.61 times as much as that having no lag angle.

FIG. 16 is a graphical representation showing a situation of an oscillating current which is actually generated in the primary winding of the step-up transformer for a cold cathode fluorescent lamp. It is understood from FIG. 16 that the current which is caused to flow through the primary winding is not an ideal sine wave, and the undesired high-order resonance currents are superposed on the current in the primary winding. When a frequency which is an integral multiple of the driving frequency of the inverter circuit agrees with the high-order resonance frequency shown in FIG. 16, the resonance phenomenon of the undesired current becomes remarkable.

Such an undesired resonance exerts a bad influence on the switching timing of the transistors Q1 and Q2. In particular the circuit using the zero current switching method for detecting the zero current to determine the switching timing as disclosed in Japanese Unexamined Patent Publication No. Sho 59-032370, U.S. Pat. No. 6,633,138, Japanese Unexamined Patent Publication No. Hei 8-288080, etc. is seriously influenced by such an undesired resonance. Consequently, it is effective to damp the oscillating current by using the regenerating method as described above.

The above-mentioned description relating to the operation has been given with respect to the case where the switching transistor Qs is synchronized in switching timing with the transistors Q1 and Q2. However, even when the switching transistor Qs is asynchronous in switching timing with the transistors Q1 and Q2, the same operation and effects as those of the foregoing can be obtained.

What is claimed is:

1. A current resonance inverter circuit for a discharge lamp comprising:

a step-up transformer; and a current transformer, a primary winding of said step-up transformer having a center tap being connected to a power source, two other terminals of said primary winding being connected to collectors of two transistors, respectively, emitters of said two transistors being connected to respective terminals of a primary winding the current transformer, the current transformer having a center tap, said center tap of said current transformer being connected to a ground side, a secondary winding of said current transformer being connected to bases of said two transistors to detect emitter currents of said two transistors in order to detect a resonance current, thereby performing oscillation, further comprising a secondary side circuit of said step-up transformer including:

an inductor with a predetermined leakage inductance value which occurs from said secondary winding;

said discharge lamp of said secondary winding;

a distributed capacitor of said secondary winding;

a capacitor for adjusting a resonance frequency; and a capacitor for handling stray capacitance generated in the vicinity of said discharge lamp, wherein the distributed capacitor, the capacitor for adjusting the resonance frequency, and the capacitor for handling stray capacitance form a secondary side capacitance, the secondary side capacitance and the predetermined leakage inductance value which occurs from said secondary winding included in the step-up transformer constituting a serial resonance circuit having a predetermined Q value, and wherein said discharge lamp is connected in parallel with the said secondary side capacitance, whereby a predetermined step-up ratio is obtained to light said discharge lamp, and a phase of the primary winding current of said step-up transformer is approximately the same as a phase of a real value of the primary winding voltage of said step-up transformer.

2. The current resonance inverter circuit for the discharge lamp according to claim 1, further comprising:

a power controlling circuit; and a switching transistor for controlling said power controlling circuit, the switching transistor being connected between said center tap of said step-up transformer and said power source, wherein switching timing of said switching transistor which controls said power controlling circuit is made (A) irrespective of an oscillation frequency of said current resonance inverter circuit, or (B) such that a phase of a waveform of an effective value of a voltage applied to said primary winding of said step-up transformer becomes substantially equal to that of a waveform of a current which is caused to flow through said primary winding, if and when an oscillation frequency of said power controlling circuit is synchronized with an oscillation frequency of a current resonance circuit.

3. The current resonance inverter circuit for the discharge lamp according to claim 2, wherein a choke coil is provided between said center tap of said step-up transformer and said switching transistor.

4. The current resonance inverter circuit for the discharge lamp according to claim 3, wherein when said switching transistor of said power controlling circuit of said current resonance inverter circuit is turned OFF, an oscillating current which is caused to flow through said primary winding of said step-up transformer due to parasitic oscillation is caused to flow in a direction opposite to that of a resonance current of said current resonance inverter circuit, whereby an energy of the resonance current due to the parasitic oscillation is regenerated in said power source, thereby damping the oscillating current.

5. The current resonance inverter circuit for the discharge lamp according to claim 4, wherein an oscillation frequency of said power controlling circuit is synchronized with an oscillation frequency of said current resonance inverter circuit, and a phase of a waveform of an effective value of a voltage applied to said primary winding of said step-up transformer becomes substantially equal to that of a waveform of a current which is caused to flow through said primary winding.

6. The current resonance inverter circuit for the discharge lamp according to claim 4, further comprising a synchronously oscillating circuit for activating the current resonance inverter circuit.

7. The current resonance inverter circuit for the discharge lamp according to claim 1, wherein a choke coil is provided between said center tap of said step-up transformer and said switching transistor.

8. The current resonance inverter circuit for the discharge lamp according to claim 7, wherein when said switching transistor of said power controlling circuit of said current resonance inverter circuit is turned OFF, an oscillating current which is caused to flow through said primary winding of said step-up transformer due to parasitic oscillation is caused to flow in a direction opposite to that of a resonance current of said current resonance inverter circuit, whereby an energy of the resonance current due to the parasitic oscillation is regenerated in said power source, thereby damping the oscillating current.

9. The current resonance inverter circuit for the discharge lamp according to claim 8, wherein an oscillation frequency of said power controlling circuit is synchronized with an oscillation frequency of a current resonance circuit, and a phase of a waveform of an effective value of a voltage applied to said primary winding of said step-up transformer becomes substantially equal to that of a waveform of a current which is caused to flow through said primary winding.

10. The current resonance inverter circuit for the discharge lamp according to claim 8, further comprising a synchronously oscillating circuit for activating the current resonance inverter circuit.

11. The current resonance inverter circuit for the discharge lamp according to claim 1, further comprising a synchronously oscillating circuit for activating the current resonance inverter circuit.

12. A current resonance inverter circuit for a discharge lamp comprising:

a step-up transformer including a predetermined leakage inductance value which occurs from a secondary winding of the step-up transformer and a secondary side capacitance and the discharge lamp;

a power source;

a power controlling circuit;

a self-oscillation circuit; and a switching transistor for controlling said power controlling circuit, the switching transistor being connected between said power source of said self-oscillation circuit and said power controlling circuit, wherein switching timing of said switching transistor which controls said power controlling circuit is made (A) irrespective of an oscillation frequency of said current resonance inverter circuit, or (B) such that a phase of a waveform of an effective value of a voltage applied to said primary winding of said step-up transformer becomes substantially equal to that of a waveform of a current which is caused to flow through said primary winding, if and when an oscillation frequency of said power controlling circuit is synchronized with an oscillation frequency of a current resonance circuit, wherein when said switching transistor of said current resonance inverter circuit is turned OFF, an oscillating current which is caused to flow through said primary winding of said step-up transformer due to a parasitic oscillation is caused to flow in a direction opposite to that of a resonance current of said current resonance inverter circuit, whereby an energy of the resonance current due to the parasitic oscillation is regenerated in said power source, thereby damping the oscillating current.

13. The current resonance inverter circuit for the discharge lamp according to claim 12, further comprising a synchronously oscillating circuit for activating the current resonance inverter circuit.

14. The current resonance inverter circuit for the discharge lamp according to claim 12, further comprising at least one capacitor forming said secondary side capacitance connected to the secondary winding side of the step up transformer, the secondary side capacitance and the inductor constituting a serial resonance circuit having a predetermined Q value.

15. The current resonance inverter circuit for the discharge lamp according to claim 14, wherein the at least one capacitor includes a capacitor for adjusting a resonance frequency in series with a distributed capacitor.

16. The current resonance inverter circuit for the discharge lamp according to claim 12, wherein the switching transistor is connected between a center tap of said step-up transformer and said power source.

17. The current resonance inverter circuit for the discharge lamp according to claim 16, wherein a choke coil is provided between said center tap of said step-up transformer and said switching transistor.

18. The current resonance inverter circuit for the discharge lamp according to claim 12, wherein a choke coil is provided between said center tap of said step-up transformer and said switching transistor.

19. The current resonance inverter circuit for the discharge lamp according to claim 18, wherein an oscillation frequency of said power controlling circuit is synchronized with an oscillation frequency of said current resonance inverter circuit, and a phase of a waveform of an effective value of a voltage applied to said primary winding of said step-up transformer becomes substantially equal to that of a waveform of a current which is caused to flow through said primary winding.

20. The current resonance inverter circuit for the discharge lamp according to claim 18, further comprising a synchronously oscillating circuit for activating the current resonance inverter circuit.

21. A current resonance inverter circuit for a discharge lamp comprising:

a step-up transformer which has a predetermined leakage inductance value which occurs from a secondary winding; and a pair of current detecting resistors; and a primary winding of said step-up transformer having a center tap being connected to a power source, two other terminals of said primary winding being connected to collectors or drains of two switching transistors, respectively, and emitters or sources of said two switching transistors being connected to respective current detecting resistors, wherein the resonance currents of the primary winding which are caused to flow through said current detecting resistors are detected, thereby obtaining switching timings of said switching transistors, and wherein the current resonance inverter circuit further comprises a synchronously oscillating circuit for activating the current resonance inverter circuit.

22. The current resonance inverter circuit for the discharge lamp according to claim 21, further comprising a secondary side circuit of said step-up transformer, said secondary side circuit including:

an inductor with a predetermined leakage inductance value;

said discharge lamp;

a distributed capacitor;

a capacitor for adjusting a resonance frequency; and a capacitor for handling stray capacitance generated in the vicinity of said discharge lamp, wherein the distributed capacitor, the capacitor for adjusting the resonance frequency, the capacitor for handling stray capacitance forming a secondary side capacitance, the secondary side capacitance and the inductor constituting a series resonance circuit having a predetermined Q value, whereby a predetermined step-up ratio is obtained to turn ON said discharge lamp, and a phase of the primary winding current of said step-up transformer is approximately the same as a phase of a real value of the primary winding voltage of said step-up transformer.

23. A current resonance inverter circuit for a discharge lamp, comprising:

a power source;

a power controlling circuit;

a fly wheel diode; and a switching transistor for controlling said power controlling circuit, wherein the switching transistor is directly connected between said power source and said fly wheel diode, and the fly wheel diode is connected to ground, and wherein switching timing of said switching transistor which controls said power controlling circuit is made (A) irrespective of an oscillation frequency of said current resonance inverter circuit, or (B) such that a phase of a waveform of an effective value of a voltage applied to said primary winding of said step-up transformer becomes substantially equal to that of a waveform of a current which is caused to flow through said primary winding, if and when an oscillation frequency of said power controlling circuit is synchronized with an oscillation frequency of a current resonance circuit, wherein when said switching transistor of said current resonance inverter circuit is turned OFF, an oscillating current which is caused to flow through a primary winding of said step-up transformer due to parasitic oscillation is caused to flow in a direction opposite to that of a resonance current of said current resonance inverter circuit, whereby an energy of the resonance current due to the parasitic oscillation is regenerated in said power source, thereby damping an oscillating current.

24. The current resonance inverter circuit for the discharge lamp according to claim 23, further comprising a choke coil provided between a center tap of a step-up transformer and said switching transistor.

* * * * *